US011906279B2

(12) United States Patent
Eitschberger

(10) Patent No.: US 11,906,279 B2
(45) Date of Patent: Feb. 20, 2024

(54) ELECTRICAL CONNECTOR

(71) Applicant: DynaEnergetics Europe GmbH, Troisdorf (DE)

(72) Inventor: Christian Eitschberger, Munich (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 28 days.

(21) Appl. No.: 17/675,372

(22) Filed: Feb. 18, 2022

(65) Prior Publication Data

US 2022/0170727 A1 Jun. 2, 2022

Related U.S. Application Data

(60) Continuation of application No. 16/819,270, filed on Mar. 16, 2020, now Pat. No. 11,293,736, which is a continuation-in-part of application No. 16/423,789, filed on May 28, 2019, now Pat. No. 10,982,941, which is a continuation of application No. 16/156,339, filed on Oct. 10, 2018, now Pat. No. 10,352,674, which is a continuation of application No. 16/056,944, filed on Aug. 7, 2018, now Pat. No.

(Continued)

(51) Int. Cl.
*F42D 1/05* (2006.01)
*F42D 1/04* (2006.01)

(52) U.S. Cl.
CPC ..... *F42D 1/05* (2013.01); *F42D 1/043* (2013.01)

(58) Field of Classification Search
CPC ..... F42D 1/05; F42D 1/043; F42D 1/04
USPC ..... 102/206
See application file for complete search history.

(56) References Cited

U.S. PATENT DOCUMENTS 2,296,346 A * 9/1942 Hearn ..... H01H 50/443 439/890
2,358,466 A 9/1944 Miller
(Continued)

FOREIGN PATENT DOCUMENTS

CA 2821506 A1 1/2015
CA 2824838 A1 2/2015
(Continued)

OTHER PUBLICATIONS

Canadian Intellectual Property Office, Office Action for CA App. No. 2923860 dated Jul. 14, 2017, 3 pages.
(Continued)

*Primary Examiner* — Alexander Gilman
(74) *Attorney, Agent, or Firm* — Womble Bond Dickinson (US) LLP

(57) ABSTRACT

An electrical connector may include a connector body extending along a longitudinal axis, a first electrical contact provided at a first end of the connector body, a first aperture provided in the first end of the connector body, a bore provided in an interior of the connector body and connected to the first aperture, and a conductive fixed body provided within the bore. The conductive fixed body may include a first contact surface on a first side of the conductive fixed body facing the first electrical contact along the longitudinal axis. A first spring may be provided in the bore between the first contact surface and the first electrical contact, and the first spring may be in contact with the first contact surface and the first electrical contact.

20 Claims, 16 Drawing Sheets

Related U.S. Application Data

10,365,078, which is a division of application No. 15/612,953, filed on Jun. 2, 2017, now Pat. No. 10,066,921, which is a division of application No. 15/068,786, filed on Mar. 14, 2016, now Pat. No. 9,784,549.

(60) Provisional application No. 62/134,893, filed on Mar. 18, 2015.

(56) References Cited

U.S. PATENT DOCUMENTS 2,439,394 A * 4/1948 Lanzalotti ..... H01B 17/301 29/523
2,889,775 A 6/1959 Owen
3,013,491 A 12/1961 Poulter
3,158,680 A 11/1964 Lovitt et al.
3,173,992 A 3/1965 Boop
3,246,707 A 4/1966 Bell
3,374,735 A 3/1968 Moore
4,007,796 A 2/1977 Boop
4,058,061 A 11/1977 Mansur, Jr. et al.
4,100,978 A 7/1978 Boop
4,266,613 A 5/1981 Boop
4,290,486 A 9/1981 Regalbuto
4,346,954 A 8/1982 Appling
4,411,491 A * 10/1983 Larkin ..... H01R 13/523 385/59
4,491,185 A 1/1985 McClure
4,523,650 A 6/1985 Sehnert et al.
4,574,892 A 3/1986 Grigar et al.
4,621,396 A 11/1986 Walker et al.
4,650,009 A 3/1987 McClure et al.
4,657,089 A 4/1987 Stout
4,660,910 A * 4/1987 Sharp ..... E21B 17/042 439/194
4,747,201 A 5/1988 Donovan et al.
4,776,393 A 10/1988 Forehand et al.
5,027,708 A 7/1991 Gonzalez et al.
5,042,594 A 8/1991 Gonzalez et al.
5,052,489 A 10/1991 Carisella et al.
5,060,573 A 10/1991 Montgomery et al.
5,105,742 A 4/1992 Sumner
5,159,145 A 10/1992 Carisella et al.
5,171,158 A * 12/1992 Cairns ..... H01R 13/523 439/190
5,223,665 A 6/1993 Burleson et al.
5,237,136 A * 8/1993 Langston ..... H01H 35/24 175/2
5,241,891 A 9/1993 Hayes et al.
5,322,019 A 6/1994 Hyland
5,334,801 A 8/1994 Mohn
5,347,929 A 9/1994 Lerche et al.
5,358,418 A * 10/1994 Carmichael ..... E21B 17/028 439/700
5,392,851 A 2/1995 Arend
5,392,860 A 2/1995 Ross
5,436,791 A 7/1995 Turano et al.
5,484,296 A * 1/1996 Taylor ..... H01R 13/523 439/669
5,574,815 A * 11/1996 Kneeland ..... H01B 11/1891 174/75 C
5,603,384 A 2/1997 Bethel et al.
5,775,426 A 7/1998 Snider et al.
5,791,914 A 8/1998 Loranger et al.
5,871,052 A 2/1999 Benson et al.
D417,252 S 11/1999 Kay
5,992,289 A 11/1999 George et al.
6,006,833 A 12/1999 Burleson et al.
6,012,525 A 1/2000 Burleson et al.
6,263,283 B1 7/2001 Snider et al.
6,298,915 B1 10/2001 George
6,354,374 B1 3/2002 Edwards et al.
6,398,583 B1 * 6/2002 Zehren ..... H01R 13/59 439/205
6,464,511 B1 10/2002 Watanabe et al.
6,511,335 B1 * 1/2003 Rayssiguier ..... H01R 13/523 439/191
6,651,747 B2 11/2003 Chen et al.
6,742,602 B2 6/2004 Trotechaud
6,752,083 B1 6/2004 Lerche et al.
6,772,868 B2 8/2004 Warner
6,773,312 B2 8/2004 Bauer et al.
6,776,668 B1 8/2004 Scyoc et al.
6,822,542 B2 11/2004 Clark et al.
6,851,471 B2 2/2005 Barlow et al.
6,902,414 B2 6/2005 Dopf et al.
7,036,598 B2 5/2006 Skjærseth et al.
7,074,064 B2 * 7/2006 Wallace ..... E21B 17/028 439/190
7,112,080 B2 * 9/2006 Nicholson ..... E21B 17/023 439/283
7,193,156 B2 * 3/2007 Alznauer ..... H02G 15/013 174/152 G
7,237,626 B2 7/2007 Gurjar et al.
7,297,004 B1 11/2007 Shuhart et al.
7,322,416 B2 1/2008 Burris, II et al.
7,364,451 B2 4/2008 Ring et al.
7,404,725 B2 7/2008 Hall et al.
7,473,104 B1 1/2009 Wertz
7,476,132 B2 1/2009 Xu
7,481,662 B1 1/2009 Rehrig
7,510,017 B2 3/2009 Howell et al.
7,530,744 B2 * 5/2009 Prel ..... G02B 6/3816 385/53
7,535,706 B2 * 5/2009 Herberholt ..... B60L 53/14 361/679.41
7,544,102 B2 6/2009 Oda
7,661,474 B2 2/2010 Campbell et al.
7,690,925 B2 4/2010 Goodman
7,726,396 B2 6/2010 Briquet et al.
7,762,351 B2 7/2010 Vidal
7,815,440 B2 10/2010 Hsieh et al.
7,901,247 B2 3/2011 Ring
7,952,035 B2 5/2011 Falk et al.
7,980,874 B2 * 7/2011 Finke ..... H01R 13/6315 439/194
8,069,789 B2 12/2011 Hummel et al.
8,091,477 B2 1/2012 Brooks et al.
8,136,439 B2 3/2012 Bell
8,181,718 B2 5/2012 Burleson et al.
8,186,259 B2 5/2012 Burleson et al.
8,246,372 B1 * 8/2012 Walters ..... H01R 13/622 439/310
8,292,645 B2 * 10/2012 Cairns ..... H01R 13/5202 439/271
8,387,533 B2 3/2013 Runkel
8,449,308 B2 5/2013 Smith
8,469,087 B2 6/2013 Gray
8,863,665 B2 10/2014 DeVries et al.
8,869,887 B2 * 10/2014 Deere ..... H01R 13/64 166/242.6
8,875,787 B2 11/2014 Tassaroli
8,950,480 B1 2/2015 Strickland
8,985,023 B2 3/2015 Mason
8,997,852 B1 4/2015 Lee et al.
9,080,433 B2 7/2015 Lanclos et al.
9,145,764 B2 9/2015 Burton et al.
9,175,553 B2 11/2015 McCann et al.
9,181,790 B2 11/2015 Mace et al.
9,194,219 B1 11/2015 Hardesty et al.
9,270,051 B1 * 2/2016 Christiansen ..... H01R 13/523
9,328,577 B2 5/2016 Hallundbaek et al.
9,382,783 B2 7/2016 Langford et al.
9,441,465 B2 9/2016 Tassaroli
9,441,470 B2 9/2016 Guerrero et al.
9,466,916 B2 * 10/2016 Li ..... E21B 17/028
9,494,021 B2 11/2016 Parks et al.
9,518,443 B2 12/2016 Tunget et al.
9,518,454 B2 12/2016 Current et al.
9,581,422 B2 2/2017 Preiss et al.

(56) References Cited

U.S. PATENT DOCUMENTS 9,605,937 B2 3/2017 Eitschberger et al.
9,620,896 B1 * 4/2017 Dubbaka ..... H01R 13/631
9,634,427 B2 * 4/2017 Lerner ..... H01R 13/5202
9,650,848 B2 5/2017 Taylor et al.
9,677,363 B2 6/2017 Schacherer et al.
9,689,223 B2 6/2017 Schacherer et al.
9,695,645 B2 7/2017 Tilley et al.
9,702,680 B2 7/2017 Parks et al.
9,784,549 B2 * 10/2017 Eitschberger ..... F42D 1/05
9,787,112 B2 * 10/2017 Sukup ..... H02J 7/0042
9,835,015 B2 12/2017 Hardesty
9,887,492 B2 * 2/2018 Umehara ..... H01R 13/631
9,926,755 B2 3/2018 Van Petegem et al.
9,963,955 B2 5/2018 Tolman et al.
10,001,007 B2 6/2018 Pelletier et al.
10,036,236 B1 7/2018 Sullivan et al.
10,053,968 B2 8/2018 Tolman et al.
10,066,921 B2 * 9/2018 Eitschberger ..... F42D 1/05
10,077,641 B2 9/2018 Rogman et al.
10,151,181 B2 12/2018 Lopez et al.
10,174,595 B2 1/2019 Knight et al.
10,188,990 B2 1/2019 Burmeister et al.
10,273,788 B2 4/2019 Bradley et al.
10,301,910 B2 5/2019 Whitsitt et al.
10,337,270 B2 7/2019 Carisella et al.
10,352,136 B2 7/2019 Goyeneche
10,352,674 B2 * 7/2019 Eitschberger ..... F42D 1/05
10,429,161 B2 10/2019 Parks et al.
10,458,213 B1 10/2019 Eitschberger et al.
10,472,901 B2 11/2019 Engel et al.
10,472,938 B2 11/2019 Parks et al.
D873,373 S 1/2020 Hartman et al.
10,677,026 B2 6/2020 Sokolove et al.
10,731,444 B2 8/2020 Wells et al.
10,746,014 B2 * 8/2020 Ito ..... E21B 47/00
10,858,919 B2 12/2020 Anthony et al.
10,900,333 B2 * 1/2021 Langford ..... E21B 17/028
10,900,334 B2 1/2021 Knight et al.
10,982,941 B2 * 4/2021 Eitschberger ..... F42D 1/05
11,118,436 B2 9/2021 Langford et al.
11,299,967 B2 4/2022 Bradley et al.
11,359,468 B2 6/2022 Roberts et al.
2004/0094305 A1 5/2004 Skjærseth et al.
2005/0016769 A1 * 1/2005 Wallace ..... E21B 17/028 175/45
2005/0186823 A1 8/2005 Ring et al.
2005/0229805 A1 10/2005 Myers, Jr. et al.
2006/0013282 A1 1/2006 Hanzawa et al.
2008/0110612 A1 5/2008 Prinz et al.
2008/0110632 A1 5/2008 Beall
2008/0134922 A1 6/2008 Grattan et al.
2008/0173204 A1 7/2008 Anderson et al.
2008/0264639 A1 10/2008 Parrott et al.
2009/0273310 A1 * 11/2009 Flack ..... H01R 24/38 439/668
2009/0301723 A1 * 12/2009 Gray ..... G01V 11/002 166/301
2010/0000789 A1 1/2010 Barton et al.
2010/0089643 A1 4/2010 Vidal
2010/0163224 A1 7/2010 Strickland
2010/0288496 A1 11/2010 Cherewyk
2011/0024116 A1 2/2011 McCann et al.
2012/0006217 A1 1/2012 Anderson
2012/0094553 A1 4/2012 Fujiwara et al.
2012/0152542 A1 6/2012 Le
2012/0160483 A1 6/2012 Carisella
2012/0199352 A1 8/2012 Lanclos et al.
2012/0241169 A1 9/2012 Hales et al.
2012/0247769 A1 10/2012 Schacherer et al.
2012/0298361 A1 11/2012 Sampson
2013/0008639 A1 1/2013 Tassaroli et al.
2013/0043074 A1 2/2013 Tassaroli
2013/0048376 A1 2/2013 Rodgers et al.
2013/0126237 A1 5/2013 Burton et al.
2013/0153205 A1 6/2013 Borgfeld et al.
2013/0199843 A1 8/2013 Ross
2013/0293184 A1 * 11/2013 Green ..... H02J 7/342 320/105
2014/0000877 A1 1/2014 Robertson et al.
2014/0083774 A1 3/2014 Hoult et al.
2015/0167410 A1 6/2015 Garber et al.
2015/0209954 A1 7/2015 Hokanson
2015/0330192 A1 11/2015 Rogman et al.
2016/0061572 A1 3/2016 Eitschberger et al.
2016/0084048 A1 3/2016 Harrigan et al.
2016/0115741 A1 4/2016 Davis
2016/0168961 A1 6/2016 Parks et al.
2016/0202033 A1 7/2016 Shahinpour et al.
2016/0215592 A1 7/2016 Helms et al.
2016/0273902 A1 * 9/2016 Eitschberger ..... F42D 1/05
2016/0290084 A1 10/2016 LaGrange et al.
2016/0298404 A1 10/2016 Beckett et al.
2016/0333675 A1 11/2016 Wells et al.
2016/0356132 A1 12/2016 Burmeister et al.
2017/0030693 A1 2/2017 Preiss et al.
2017/0052011 A1 2/2017 Parks et al.
2017/0067303 A1 3/2017 Thiemann et al.
2017/0138150 A1 5/2017 Yencho
2017/0159379 A1 6/2017 Metcalf et al.
2017/0167233 A1 6/2017 Sampson et al.
2017/0175488 A1 6/2017 Lisowski et al.
2017/0199015 A1 7/2017 Collins et al.
2017/0204687 A1 7/2017 Yorga et al.
2017/0211363 A1 7/2017 Bradley et al.
2017/0241244 A1 8/2017 Barker et al.
2017/0268860 A1 9/2017 Eitschberger
2017/0276465 A1 9/2017 Parks et al.
2017/0298716 A1 10/2017 McConnell et al.
2017/0306710 A1 10/2017 Trydal et al.
2017/0314373 A9 11/2017 Bradley et al.
2018/0030334 A1 2/2018 Collier et al.
2018/0119529 A1 5/2018 Goyeneche
2018/0202789 A1 7/2018 Parks et al.
2018/0202790 A1 7/2018 Parks et al.
2018/0209250 A1 7/2018 Daly et al.
2018/0299239 A1 * 10/2018 Eitschberger ..... F42D 1/045
2018/0318770 A1 11/2018 Eitschberger et al.
2019/0040722 A1 2/2019 Yang et al.
2019/0048693 A1 2/2019 Henke et al.
2019/0049225 A1 2/2019 Eitschberger
2019/0085685 A1 3/2019 McBride
2019/0162055 A1 5/2019 Collins et al.
2019/0162056 A1 * 5/2019 Sansing ..... F41A 19/65
2019/0195054 A1 6/2019 Bradley et al.
2019/0211655 A1 7/2019 Bradley et al.
2019/0234188 A1 8/2019 Goyeneche
2019/0257181 A1 * 8/2019 Langford ..... E21B 43/1185
2019/0292887 A1 9/2019 Austin, II et al.
2019/0330961 A1 10/2019 Knight et al.
2019/0338612 A1 11/2019 Holodnak et al.
2019/0353013 A1 11/2019 Sokolove et al.
2019/0368293 A1 12/2019 Covalt et al.
2020/0024934 A1 1/2020 Eitschberger et al.
2020/0024935 A1 1/2020 Eitschberger et al.
2020/0032626 A1 1/2020 Parks et al.
2020/0063537 A1 2/2020 Langford et al.
2020/0063553 A1 2/2020 Zemla et al.
2020/0088011 A1 3/2020 Eitschberger et al.
2020/0182025 A1 6/2020 Brady
2020/0199983 A1 6/2020 Preiss et al.
2020/0284126 A1 9/2020 Mauldin et al.
2022/0282578 A1 * 9/2022 Eitschberger ..... E21B 17/028

FOREIGN PATENT DOCUMENTS

CA 2941648 A1 9/2015
CA 3021913 A1 2/2018
CN 85107897 A 9/1986
CN 2661919 12/2004
CN 201209435 3/2009
CN 201428439 3/2010
CN 101691837 B 4/2010
CN 201507296 U 6/2010
CN 202431259 U 9/2012

(56) References Cited

FOREIGN PATENT DOCUMENTS

| | | | |
|---|---|---|---|
| CN | 103993861 | A | 8/2014 |
| CN | 204430910 | U | 7/2015 |
| CN | 207847603 | U | 9/2018 |
| CN | 209195374 | U | 8/2019 |
| CN | 110424930 | A | 11/2019 |
| CN | 209780779 | U | 12/2019 |
| CN | 209908471 | U | 1/2020 |
| CN | 210948614 | U | 7/2020 |
| EP | 0416915 | A2 | 3/1991 |
| EP | 0180520 | B1 | 5/1991 |
| EP | 0721051 | A3 | 4/1998 |
| EP | 1688584 | B1 | 8/2011 |
| GB | 2404291 | A | 1/2005 |
| GB | 2531450 | B | 2/2017 |
| GB | 2544247 | A | 5/2017 |
| GB | 2548101 | A | 9/2017 |
| GB | 2548203 | A | 9/2017 |
| IN | 201620848 | U | 11/2010 |
| RU | 2175379 | C2 | 10/2001 |
| RU | 2489567 | C1 | 8/2013 |
| WO | 2015006869 | A1 | 1/2015 |
| WO | 2015028204 | A2 | 3/2015 |
| WO | 2018009223 | A1 | 1/2018 |
| WO | 2018057934 | A1 | 3/2018 |
| WO | 2019148009 | A2 | 8/2019 |
| WO | 2019204137 | A1 | 10/2019 |
| WO | 2020139459 | A2 | 7/2020 |
| WO | 2021198193 | A1 | 10/2021 |

OTHER PUBLICATIONS

Canadian Intellectual Property Office, Office Action for CA App. No. 2923860 dated Nov. 25, 2016, 3 pages.
Canadian Intellectual Property Office; Office Action for CA App. No. 3,015,102; dated Jun. 17, 2019; 4 pgs.
Federal Institute of Industrial Property; Inquiry for RU App. No. 2016109329/03(014605); issued Jul. 10, 2019; 7 pages (Eng. Translation 5 pages).
State Intellectual Property Office, P.R. China; First Office Action for Chinese App. No. 201610153426. X; dated Mar. 20, 2019; 6 pages (Eng Translation 11 pages).
United States Patent and Trademark Office, Non-Final Office Action of U.S. Appl. No. 16/423,789, dated Feb. 18, 2020, 14 pages.
International Searching Authority; International Search Report and Written Opinion of the International Searching Authority for PCT/EP2022/055192; dated May 16, 2022; 15 pages.
United States Patent and Trademark Office; Final Office Action for U.S. Appl. No. 17/677,478; dated Sep. 21, 2022; 8 pages.
United States Patent and Trademark Office; Non-Final Office Action for U.S. Appl. No. 17/677,478; dated Jun. 29, 2022; 9 pages.
Amit Govil, Selective Perforation: A Game Changer in Perforating Technology—Case Study, presented at the 2012 European and West African Perforating Symposium, Schlumberger, Nov. 7-9, 2012, 14 pgs.
Bear Manufacturing, LLC; Defendant Bear Manufacturing, LLC's Answer, Affirmative Defenses and Counterclaim in response to Plaintiffs' Complaint for Civil Action No. 3:21-cv-00185-M; dated Mar. 22, 2021; 14 pages.
Brazilian Patent and Trademark Office; Search Report for BR Application No. BR112015033010-0; dated May 5, 2020; (4 pages).
Buche & Associates, P.C.; Rule 501 Citation of Prior Art and Written "Claim Scope Statements" in U.S. Pat. No. 10,844,697; dated Mar. 3, 2021; 24 pages.
Canadian Intellectual Property Office; Office Action for CA Appl. No. 2,821,506; dated Mar. 21, 2019; 4 pages.
Canadian Intellectual Property Office; Office Action for CA Application No. 2,941,648; dated Mar. 15, 2021; 3 pages.
Canadian Intellectual Property Office; Office Action for CA Application No. 3,015,102; dated Feb. 4, 2022; 3 pages.
Canadian Intellectual Property Office; Office Action for CA Application No. 3,015,102; dated May 5, 2021; 3 pages.
Canadian Intellectual Property Office; Office Action for CA Application No. 3,070,118; dated Mar. 16, 2021; 3 pages.
Coil Spring; Exhibit 1024 of PGR No. 2021-00078; dated Apr. 2, 2021; 4 pages.
Core Lab, ZERO180™ Gun SystemAssembly and Arming Procedures—MAN-Z180-000 (RO7), Dec. 4, 2019, 33 pgs., https://www.corelab.com/owen/CMS/docs/Manuals/gunsys/zero180/MAN-Z180-000.pdf.
CoreLab Quick Change Assembly; Exhibit No. 1034 of PGR No. 2021-00078; dated Aug. 2002; 1 page.
Dynaenergetics Europe GMBH; Complaint and Demand for Jury Trial for Civil Action No. 4:21-cv-00280; dated Jan. 28, 2021; 55 pages.
Dynaenergetics Europe; Defendants' Preliminary Infringement Contentions for Civil Action No. 3:20-CV-00376; dated Mar. 25, 2021; 22 pages.
Dynaenergetics Europe; DynaEnergetics Europe GMBH and DynaEnergetics US, Inc.'s Answer to Complaint and Counterclaim Civil Action No. 3:20-cv-000376; dated Mar. 8, 2021; 23 pages.
Dynaenergetics Europe; Patent Owner's Preliminary Response for PGR No. 2020-00080; dated Nov. 18, 2020; 119 pages.
Dynaenergetics GMBH & CO. KG, Patent Owner's Response to Hunting Titan's Petition for Inter Parties Review—Case IPR2018-00600, filed Dec. 6, 2018, 73 pages.
Dynaenergetics GmbH & Co. KG; Patent Owner's Precedential Opinion Panel Request for Case IPR2018-00600; Sep. 18, 2019, 2 pg.
Dynaenergetics, Selective Perforating Switch, Product Information Sheet, May 27, 2011, 1 pg.
Dynaenergetics, Through Wire Grounded Bulkhead (DynaTWG). May 25, 2016, 1 pg., https://www.dynaenergetics.com/uploads/files/5756f884e289a_U233%20DynaTWG%20Bulkhead.pdf.
EP Patent Office—International Searching Authority, PCT Search Report and Written Opinion for PCT Application No. PCT/EP2014/065752, dated May 4, 2015, 12 pgs.
Eric H. Findlay, Jury Trial Demand in Civil Action No. 6:20-cv-00069-ADA, dated Apr. 22, 2020, 32 pages.
European Patent Office; Invitation to Correct Deficiencies noted in the Written Opinion for European App. No. 15721178.0; dated Dec. 13, 2016; 2 pages.
European Patent Office; Office Action for EP App. No. 15721178.0; dated Sep. 6, 2018; 5 pages.
Federal Institute of Industrial Property; Decision on Granting a Patent for Invention Russian App. No. 2016139136/03(062394); dated Nov. 8, 2018; 20 pages (Eng Translation 4 pages); Concise Statement of Relevance: Search Report at 17-18 of Russian-language document lists several 'A' references based on RU application claims.
Federal Institute of Industrial Property; Inquiry for RU Application No. 2016110014/03(015803); issued Feb. 1, 2018; 6 pages (Eng. Translation 4 pages).
G&H Diversified Manufacturing LP; Petition for Post Grant Review PGR No. 2021-00078; dated May 10, 2021; 122 pages.
GB Intellectual Property Office, Examination Report for GB App. No. GB1600085.3, dated Mar. 9, 2016, 1 pg.
GB Intellectual Property Office, Search Report for App. No. GB 1700625.5; dated Jul. 7, 2017; 5 pgs.
GB Intellectual Property Office; Examination Report for GB Appl. No. 1717516.7; dated Apr. 13, 2018; 3 pages.
GB Intellectual Property Office; Office Action for GB App. No. 1717516.7; dated Feb. 27, 2018; 6 pages.
GB Intellectual Property Office; Search Report for GB. Appl. No. 1700625.5; dated Dec. 21, 2017; 5 pages.
German Patent Office, Office Action for German Patent Application No. 10 2013 109 227.6, which is in the same family as PCT Application No. PCT/EP2014/065752, see p. 5 for references cited, dated May 22, 2014, 8 pgs.
Hunting Energy Service, ControlFire RF Safe ControlFire® RF-Safe Manual, 33 pgs., Jul. 2016, http://www.hunting-intl.com/media/2667160/ControlFire%20RF_Assembly%20Gun%20Loading_Manual.pdf.

(56) References Cited

OTHER PUBLICATIONS

Hunting Energy Services Pte Ltd., "H-1 Perforating Gun System"; promotional brochure; Jun. 21, 2019.
Hunting Energy Services Pte Ltd., "H-2 Perforating System"; promotional brochure; Feb. 12, 2020.
Hunting Titan Inc.; Petition for Post Grant Review of U.S. Pat. No. 10,429,161; dated Jun. 30, 2020; 109 pages.
Hunting Titan Ltd.; Petition for Inter Partes Review of U.S. Pat. No. 9,581,422 Case No. IPR2018-00600; dated Feb. 16, 2018; 93 pages.
Hunting Titan, Electrical Cable Heads, May 8, 2016, 4 pgs., http://www.hunting-intl.com/media/1967991/ElectricalCableHeads.pdf.
Hunting Titan, H-1® Perforating Gun System, 2016, 2 pgs., http://www.hunting-intl.com/titan.
Hunting Titan, Wireline Top Fire Detonator Systems, Nov. 24, 2014, 2 pgs, http://www.hunting-intl.com/titan/perforating-guns-and-setting-tools/wireline-top-fire-detonator-systems.
Hunting Wireline Hardware Brochures; Exhibit No. 1025 of PGR No. 2021-00078; dated 2013; 27 pages.
Industrial Property Office, Czech Republic; Office Action for CZ App. No. PV 2017-675; Jul. 18, 2018; 2 pages; Concise Statement of Relevance: Examiner's objection of CZ application claims 1, 7, and 16 based on US Pub No. 20050194146 alone or in combination with WO Pub No. 2001059401.
Industrial Property Office, Czech Republic; Office Action for CZ App. No. PV 2017-675; dated Oct. 26, 2018; 2 pages.
Industrial Property Office, Czech Republic; Office Action; CZ App. No. PV 2017-675; dated Dec. 17, 2018; 2 pages.
Instituto Nacional De La Propiedad Industrial; Office Action for AR Appl. No. 20140102653; dated May 9, 2019 (1 page).
Intellectual Property India, Office Action of IN Application No. 201647004496, dated Jun. 7, 2019, 6 pgs.
International Searching Authority, International Preliminary Report on Patentability for PCT App. No. PCT/EP2014/065752; dated Mar. 1, 2016, 10 pgs.
International Searching Authority, International Search Report and Written Opinion for PCT App. No. PCT/IB2019/000526; dated Sep. 25, 2019, 17 pgs.
International Searching Authority, International Search Report and Written Opinion for PCT App. No. PCT/IB2019/000569; dated Oct. 9, 2019, 12 pages.
United States Patent and Trademark Office, Final Written Decision of Case IPR2018-00600 for U.S. Pat. No. 9,581,422 B2, Paper No. 42, dated Aug. 20, 2019, 31 pgs.
United States Patent and Trademark Office, Non-Final Office Action of U.S. Appl. No. 16/451,440, dated Oct. 24, 2019, 22 pages.
United States Patent and Trademark Office, Non-Final Office Action of U.S. Appl. No. 14/767,058, dated Jul. 15, 2016, 9 pages.
United States Patent and Trademark Office, Non-Final Office Action of U.S. Appl. No. 15/117,228, dated May 31, 2018, 9 pages.
United States Patent and Trademark Office, Non-Final Office Action of U.S. Appl. No. 15/617,344, dated Jan. 23, 2019, 5 pages.
United States Patent and Trademark Office, Non-Final Office Action of U.S. Appl. No. 15/788,367, dated Oct. 22, 2018, 6 pages.
United States Patent and Trademark Office, Non-Final Office Action of U.S. Appl. No. 15/920,800, dated Dec. 27, 2019, 6 pages.
United States Patent and Trademark Office, Non-Final Office Action of U.S. Appl. No. 15/920,812, dated Dec. 27, 2019, 6 pages.
United States Patent and Trademark Office, Non-Final Office Action of U.S. Appl. No. 15/920,812, dated May 27, 2020, 5 pages.
United States Patent and Trademark Office, Non-Final Office Action of U.S. Appl. No. 16/026,431, dated Jul. 30, 2019, 10 pages.
United States Patent and Trademark Office, Non-Final Office Action of U.S. Appl. No. 16/272,326, dated May 24, 2019, 17 pages.
United States Patent and Trademark Office, Non-Final Office Action of U.S. Appl. No. 16/359,540, dated May 3, 2019, 11 pages.
United States Patent and Trademark Office, Non-Final Office Action of U.S. Appl. No. 16/455,816, dated Jan. 13, 2020, 14 pages.
United States Patent and Trademark Office, Non-Final Office Action of U.S. Appl. No. 16/455,816, dated Jul. 2, 2020, 15 pages.
United States Patent and Trademark Office, Non-Final Office Action of U.S. Appl. No. 16/455,816, dated Nov. 5, 2019, 17 pages.
United States Patent and Trademark Office, Office Action of U.S. Appl. No. 16/540,484, dated Oct. 4, 2019, 12 pgs.
United States Patent and Trademark Office, Office Action of U.S. Appl. No. 16/585,790, dated Nov. 12, 2019, 9 pgs.
United States Patent and Trademark Office, Office Action of U.S. Appl. No. 16/809,729, dated Jun. 19, 2020, 9 pgs.
United States Patent and Trademark Office, Office Action of U.S. Appl. No. 16/858,041, dated Jun. 16, 2020, 11 pgs.
United States Patent and Trademark Office, Office Action of U.S. Appl. No. 29/733,080, dated Jun. 26, 2020, 8 pgs.
United States Patent and Trademark Office, Office Action of U.S. Appl. No. 29/733,325, dated Jun. 26, 2020, 9 pgs.
United States Patent and Trademark Office; Advisory Action Before the Filing of an Appeal Brief for U.S. Appl. No. 16/540,484; dated May 19, 2021; 3 pages.
United States Patent and Trademark Office; Final Office Action for U.S. Appl. No. 16/540,484; dated Feb. 19, 2021; 12 pages.
United States Patent and Trademark Office; Final Office Action for U.S. Appl. No. 16/819,270; dated Jun. 24, 2021; 11 pages.
United States Patent and Trademark Office; Final Office Action for U.S. Appl. No. 17/004,966; dated Mar. 12, 2021; 18 pages.
United States Patent and Trademark Office; Final Office Action of U.S. Appl. No. 16/540,484; dated Mar. 30, 2020; 12 pgs.
United States Patent and Trademark Office; Non-Final Office Action for U.S. Appl. No. 15/068,786; dated Mar. 27, 2017; 9 pages.
United States Patent and Trademark Office; Non-Final Office Action for U.S. Appl. No. 15/612,953; dated Feb. 14, 2018; 10 pages.
United States Patent and Trademark Office; Non-Final Office Action for U.S. Appl. No. 16/056,944; dated Mar. 18, 2019; 12 pages.
United States Patent and Trademark Office; Non-Final Office Action for U.S. Appl. No. 16/156,339; dated Dec. 13, 2018; 8 pages.
United States Patent and Trademark Office; Non-Final Office Action for U.S. Appl. No. 15/920,812; dated Feb. 3, 2021; 7 pages.
United States Patent and Trademark Office; Non-Final Office Action for U.S. Appl. No. 16/819,270; dated Feb. 10, 2021; 13 pages.
United States Patent and Trademark Office; Non-Final Office Action for U.S. Appl. No. 17/007,574; dated Jan. 29, 2021; 11 pages.
United States Patent and Trademark Office; Notice of Allowance for U.S. Appl. No. 16/809,729; dated Jan. 26, 2021; 9 pages.
United States Patent and Trademark Office; Notice of Allowance for U.S. Appl. No. 16/819,270; dated Oct. 22, 2021; 7 pages.
United States Patent and Trademark Office; Notice of Allowance for U.S. Appl. No. 17/007,574; dated May 21, 2021; 8 pages.
United States Patent Trial and Appeal Board; Institution Decision for PGR 2020-00080; dated Feb. 12, 2021; 15 pages.
Yellow Jacket Oil Tools; Tandem Sub; 2019; 3 pages.
International Searching Authority, The International Search Report and Written Opinion of International App. No. PCT/IB2019/000537, dated Sep. 25, 2019, 18 pgs.
International Searching Authority; International Preliminary Report on Patentability for PCT Appl. No. PCT/CA2014/050673; dated Jan. 19, 2016; 5 pages.
International Searching Authority; International Search Report and Written Opinion for PCT App. No. PCT/CA2014/050673; dated Oct. 9, 2014; 7 pages.
International Searching Authority; International Search Report and Written Opinion for PCT App. No. PCT/EP2015/059381; dated Nov. 23, 2015; 14 pages.
International Searching Authority; International Search Report and Written Opinion for PCT App. No. PCT/EP2019/066919; dated Sep. 10, 2019; 11 pages.
International Searching Authority; International Search Report and Written Opinion for PCT App. No. PCT/EP2019/069165; dated Oct. 22, 2019; 13 pages.
International Searching Authority; International Search Report and Written Opinion for PCT App. No. PCT/EP2019/072032; dated Nov. 15, 2019; 13 pages.
International Searching Authority; International Search Report and Written Opinion for PCT App. No. PCT/EP2019/072064; dated Nov. 20, 2019; 15 pages.

(56) References Cited

OTHER PUBLICATIONS

International Searching Authority; International Search Report and Written Opinion for PCT App. No. PCT/US2015/018906; dated Jul. 10, 2015; 12 pages.
International Searching Authority; International Search Report and Written Opinion of the International Searching Authority for PCT/EP2020/085624; dated Apr. 12, 2021; 11 pages.
Jet Research Center Inc., JRC Catalog, 2008, 36 pgs., https://www.jetresearch.com/content/dam/jrc/Documents/Books_Catalogs/06_Dets.pdf.
Jet Research Center, Velocity™ Perforating System Plug and Play Guns For Pumpdown Operation, Ivarado, Texas, Jul. 2019, 8 pgs., https://www.jetresearch.com/content/dam/jrc/Documents/Brochures/jrc-velocity-perforating- system.pdf.
Johnson, Bryce; Rule 501 citation of prior art and written "claim scope statements" in U.S. Pat. No. 10,844,697; dated Apr. 29, 2021; 18 pages.
Nexus Perforating LLC; Answer to DynaEnergetics Europe GMBH and DynaEnergetics US Inc/'s Complaint and Counterclaims; dated Apr. 15, 2021; 10 pages.
Nexus Perforating; Double Nexus Connect; 1 page, https://www.nexusperforating.com/double-nexus-connect.
Norwegian Industrial Property Office; Office Action and Search Report for NO App. No. 20160017; dated Jun. 15, 2017; 5 pages.
Norwegian Industrial Property Office; Office Action and Search Report for NO App. No. 20171759; dated Jan. 14, 2020; 6 pages.
Norwegian Industrial Property Office; Office Action for NO. Appl. No. 20160017; dated Dec. 4, 2017; 2 pages.
Norwegian Industrial Property Office; Opinion for NO Appl. No. 20171759; dated Apr. 5, 2019; 1 page.
Owen Oil Tools, E & B Select Fire Side Port, Tandem Sub, Apr. 2010, 2 pgs., https://www.corelab.com/owen/cms/docs/Canada/10A_eandbsystem-01.0-c.pdf.
Owen Oil Tools, Expendable Perforating Guns, Jul. 2008, 7 pgs., https://www.corelab.com/owen/cms/docs/Canada/10A_erhsc-01.0-c.pdf.
Owen Oil Tools; CoreLab Safe Ignition System Owen Det Bodies; dated 2015; 12 pages.
Parrott, Robert; Declaration for PGR No. 2021-00078; dated May 10, 2021; 182 pages.
Robert Parrott, Case IPR2018-00600 for U.S. Pat. No. 9,581,422 B2, Declaration regarding Patent Invalidity, dated Jun. 29, 2020, 146 pages.
Schlumberger, Perforating Services Catalog, 2008, 521 pages.
State Intellectual Property Office People's Republic of China; First Office Action for Chinese App. No. 201811156092.7; dated Jun. 16, 2020; 6 pages (Eng Translation 8 pages).
State Intellectual Property Office, P.R. China; First Office Action for Chinese App No. 201580011132.7; dated Jun. 27, 2018; 5 pages (Eng. Translation 9 pages).
State Intellectual Property Office, P.R. China; First Office Action for CN App. No. 201480047092.7; dated Apr. 24, 2017.
State Intellectual Property Office, P.R. China; First Office Action with full translation for CN App. No. 201480040456.9; dated Mar. 29, 2017; 12 pages (English translation 17 pages).
State Intellectual Property Office, P.R. China; Notification to Grant Patent Right for Chinese App. No. 201580011132.7; dated Apr. 3, 2019; 2 pages (Eng. Translation 2 pages).
State Intellectual Property Office, P.R. China; Second Office Action for CN App. No. 201480040456.9; dated Nov. 29, 2017; 5 pages (English translation 1 page).
State Intellectual Property Office, P.R. China; Second Office Action for CN App. No. 201480047092.7; dated Jan. 4, 2018; 3 pages.
SWM International Inc.; "Thunder Disposable Gun System"; promotional brochure; Oct. 2018; 5 pgs.
Thilo Scharf, "DynaEnergetics exhibition and product briefing"; pp. 5-6; presented at 2014 Offshore Technology Conference; May 2014.
U.S. Patent Trial and Appeal Board, Institution of Inter Partes Review of U.S. Pat. No. 9,581,422, Case PR2018-00600, Aug. 21, 2018, 9 pages.
United States Patent and Trademark Office, Case IPR2018-00600 for U.S. Pat. No. 9,581,422 B2, Reply in Support of Patent Owner's Motion to Amend, dated Mar. 21, 2019, 15 pgs.
United States Patent and Trademark Office, Case IPR2018-00600 for U.S. Pat. No. 9,581,422 B2, Decision of Precedential Opinion Panel, Granting Patent Owner's Request for Hearing and Granting Patent Owner's Motion to Amend, dated Jul. 6, 2020, 27 pgs.
United States Patent and Trademark Office, Case IPR2018-00600 for U.S. Pat. No. 9,581,422 B2, DynaEnergetics GmbH & Co. KG's Patent Owner Preliminary Response, dated May 22, 2018, 47 pgs.
United States Patent and Trademark Office, Case IPR2018-00600 for U.S. Pat. No. 9,581,422 B2, Order Granting Precedential Opinion Panel, Paper No. 46, dated Nov. 7, 2019, 4 pgs.
United States Patent and Trademark Office, Case IPR2018-00600 for U.S. Pat. No. 9,581,422 B2, Patent Owner's Motion to Amend, dated Dec. 6, 2018, 53 pgs.
United States Patent and Trademark Office, Case IPR2018-00600 for U.S. Pat. No. 9,581,422 B2, Patent Owner's Opening Submission to Precedential Opinion Panel, dated Dec. 20, 2019, 21 pgs.
United States Patent and Trademark Office, Case IPR2018-00600 for U.S. Pat. No. 9,581,422 B2, Patent Owner's Request for Hearing, dated Sep. 18, 2019, 19 pgs.
United States Patent and Trademark Office, Case IPR2018-00600 for U.S. Pat. No. 9,581,422 B2, Patent Owner's Responsive Submission to Precedential Opinion Panel, dated Jan. 6, 2020, 16 pgs.
United States Patent and Trademark Office, Case IPR2018-00600 for U.S. Pat. No. 9,581,422 B2, Patent Owner's Sur-reply, dated Mar. 21, 2019, 28 pgs.
United States Patent and Trademark Office, Case IPR2018-00600 for U.S. Pat. No. 9,581,422 B2, Petitioner's Additional Briefing to the Precedential Opinion Panel, dated Dec. 20, 2019, 23 pgs.
United States Patent and Trademark Office, Case IPR2018-00600 for U.S. Pat. No. 9,581,422 B2, Petitioner's Opposition to Patent Owner's Motion to Amend, dated Mar. 7, 2019, 30 pgs.
United States Patent and Trademark Office, Case IPR2018-00600 for U.S. Pat. No. 9,581,422 B2, Petitioner's Reply Briefing to the Precedential Opinion Panel, dated Jan. 6, 2020, 17 pgs.
United States Patent and Trademark Office, Case IPR2018-00600 for U.S. Pat. No. 9,581,422 B2, Petitioner's Reply in Inter Partes Review of U.S. Pat. No. 9,581,422, dated Mar. 7, 2019, 44 pgs.
United States Patent and Trademark Office, Final Office Action of U.S. Appl. No. 16/359,540, dated Aug. 14, 2019, 9 pages.
United States Patent and Trademark Office, Final Office Action of U.S. Appl. No. 16/455,816, dated Apr. 20, 2020, 21 pages.

* cited by examiner

ELECTRICAL CONNECTOR

CROSS-REFERENCE TO RELATED APPLICATIONS

This application is a continuation of Ser. No. 16/819,270 filed Mar. 16, 2020, which is a continuation-in-part patent application of U.S. application Ser. No. 16/423,789 filed May 28, 2019, (issued as U.S. Pat. No. 10,982,941 on Apr. 20, 2021), which is a continuation of U.S. application Ser. No. 16/156,339 filed Oct. 10, 2018 (issued as U.S. Pat. No. 10,352,674 on Jul. 16, 2019), which is a continuation of U.S. application Ser. No. 16/056,944 filed Aug. 7, 2018 (issued as U.S. Pat. No. 10,365,078 on Jul. 30, 2019), which is a divisional patent application of U.S. application Ser. No. 15/612,953 filed Jun. 2, 2017 (issued as U.S. Pat. No. 10,066,921 on Sep. 4, 2018), which is a divisional patent application of U.S. application Ser. No. 15/068,786 filed Mar. 14, 2016 (issued as U.S. Pat. No. 9,784,549 on Oct. 10, 2017), which claims the benefit of U.S. Provisional Application No. 62/134,893 filed Mar. 18, 2015, each of which is incorporated herein by reference in its entirety.

FIELD

Described generally herein is a bulkhead assembly having a pivotable electric contact component for use with a downhole tool, that is, any piece of equipment that is used in a well.

BACKGROUND

In exploration and extraction of hydrocarbons, such as fossil fuels (e.g. oil) and natural gas, from underground wellbores extending deeply below the surface, various downhole tools are inserted below the ground surface and include sometimes complex machinery and explosive devices. Examples of the types of equipment useful in exploration and extraction, in particular for oil well drilling applications, include logging tools and perforation gun systems and assemblies. It is often useful to be able to maintain a pressure across one or more components, (that is, to provide a "pressure barrier"), as necessary to ensure that fluid does not leak into the gun assembly, for instance. It is not uncommon that components such as a bulkhead and an initiator are components in such perforating gun assemblies that succumb to pressure leakage.

Upon placement into the perforating gun assembly, one or more initiators, (typically a detonator or an igniter), have traditionally required physical connection of electrical wires. The electrical wires typically travel from the surface down to the perforating gun assembly, and are responsible for passing along the surface signal required to initiate ignition. The surface signal typically travels from the surface along the electrical wires that run from the surface to one or more detonators positioned within the perforating gun assembly. Passage of such wires through the perforating gun assembly, while maintaining a pressure differential across individual components, has proved challenging.

Assembly of a perforating gun requires assembly of multiple parts, which typically include at least the following components: a housing or outer gun barrel within which is positioned a wired electrical connection for communicating from the surface to initiate ignition, an initiator or detonator, a detonating cord, one or more charges which are held in an inner tube, strip or carrying device and, where necessary, one or more boosters. Assembly typically includes threaded insertion of one component into another by screwing or twisting the components into place, optionally by use of a tandem-sub adapter. Since the wired electrical connection often must extend through all of the perforating gun assembly, it is easily twisted and crimped during assembly. Further, the wired electrical connections, to a detonator or initiator, usually require use of an electrical ground wire connectable to the electrical wire and extending through the housing in order to achieve a ground contact. When a ground contact is desired, the electrical ground wire must also be connected to an often non-defined part of the perforating gun assembly. Thus, the ground wire is sometimes wedged on or in between threads of hardware components and/or twisted around a metal edge of the housing of the perforating gun assembly. One issue with this arrangement is that it can be a source of intermittent and/or failed electrical contact. In addition, when a wired detonator is used it must be manually connected to the electrical wire, which has led to multiple problems. Due to the rotating assembly of parts, the electrical ground wires can become compromised, that is to say the electrical ground wires can become torn, twisted and/or crimped/nicked, or the wires may be inadvertently disconnected, or even mis-connected in error during assembly, not to mention the safety issues associated with physically and manually wiring live explosives.

According to the prior art and as shown in FIG. 1, a wired bulkhead 10' of the prior art is depicted. In a perforating gun assembly, the bulkhead 10' may be utilized to accommodate electrical and ballistic transfer (via wired electric connection 170', shown with an insulator 172' covering one end of the electrical contact component 20', which extends through the body of the bulkhead 10') to the electric connection of a next gun assembly in a string of gun assemblies, for as many gun assembly units as may be required depending on the location of underground oil or gas formation. Such bulkhead assemblies are usually provided with fixed pin contacts extending from either end of the assembly. Typically the bulkhead is employed to provide the electrical contact or feed-through in order to send electrical signals to the initiator or a type of switching system. In such applications, the pressure bulkhead is required to remain pressure sealed even under high temperatures and pressures as may be experienced in such applications, both during operation and also after detonation of the perforating gun, for instance, so that a neighboring perforating gun or downhole tool device does not become flooded with wellbore fluid or exposed to the wellbore pressure. Maintenance of the pressure differential across such devices occurs via usage of rubber components including o-rings 32', rubber stoppers and the like.

Such bulkhead assemblies are common components, particularly when a string of downhole tools is required, and is a pressure barrier or component through which electronic componentry and/or electrical wiring and electrical ground wiring must pass, (e.g. electric feed-through), and a need exists to provide such componentry with electric feed-through while maintaining a differential pressure across the component, and without compromising the electrical connection.

Improvements to the way electrical connections are accomplished in this industry include connections and arrangements as found in commonly assigned patent applications PCT/EP2012/056609 (in which an initiator head is adapted to easily introduce external wires into the plug without having to strip the wires of insulation beforehand) and PCT/EP2014/065752 (in which a wireless initiator is provided), which are incorporated herein by reference in their entireties.

The assembly described herein further solves the problems associated with prior known assemblies in that it provides, in an embodiment, an assembly that allows improved assembly in the field while maintaining the integrity of the electrical connection, as described in greater detail hereinbelow.

BRIEF DESCRIPTION

An exemplary embodiment an electrical connector may include a connector body extending along a longitudinal axis, a first electrical contact provided at a first end of the connector body, a first aperture provided in the first end of the connector body, a bore provided in an interior of the connector body and connected to the first aperture, and a conductive fixed body provided within the bore. The conductive fixed body may include a first contact surface on a first side of the conductive fixed body facing the first electrical contact along the longitudinal axis. A first spring may be provided in the bore between the first contact surface and the first electrical contact, and the first spring may be in contact with the first contact surface and the first electrical contact.

An exemplary embodiment of an electrical connector may include a connector body extending along a longitudinal axis, a first electrical contact provided at a first end of the connector body, a second electrical contact provided at a second end of the connector body, a first aperture provided in the first end of the connector body, a second aperture provided in the second end of the connector body, a bore provided in an interior of the connector body and connected to the first aperture, and a conductive fixed body provided within the bore. The conductive fixed body may include a first contact surface on a first side of the conductive fixed body facing the first electrical contact along the longitudinal axis and a second contact surface provided on a second side of the conductive fixed body facing the second electrical contact along the longitudinal axis. A first spring may be provided in the bore between the first contact surface and the first electrical contact, and the first spring may be in contact with the first contact surface and the first electrical contact. A second spring may be provided in the bore between the second contact surface and the second electrical contact, and the second spring may be in contact with the second contact surface and the second electrical contact.

An exemplary embodiment of an electrical connector may include a connector body extending along a longitudinal axis, a first electrical contact provided at a first end of the connector body, a first aperture provided in the first end of the connector body, a bore provided in an interior of the connector body, the bore being connected to the first aperture, and a conductive fixed body provided within the bore. The conductive fixed body may include a first contact surface on a first side of the conductive fixed body facing the first electrical contact along the longitudinal axis. A first spring may be provided in the bore between the first contact surface and the first electrical contact, and the first spring may be in contact with the first contact surface and the first electrical contact. The bore may include a first bore portion having a first bore diameter and a second bore portion axially adjacent to the first bore portion and having a second bore diameter larger than the first bore diameter. The connector body may further include an annular shoulder formed at a transition between the first bore portion and the second bore portion. The first contact surface may abut the annular shoulder. The first spring and at least a portion of the first electrical contact may be disposed within the first bore portion.

BRIEF DESCRIPTION OF THE FIGURES

A more particular description briefly described above will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to various embodiments. Each example is provided by way of explanation, and is not meant as a limitation and does not constitute a definition of all possible embodiments.

A bulkhead assembly is generally described herein, having particular use in conjunction with a downhole tool, and in particular to applications requiring the bulkhead assembly to maintain a pressure, and is thus commonly referred to as a pressure bulkhead assembly. In an embodiment, the bulkhead assembly is configured for use with a logging tool or a perforating gun assembly, in particular for oil well drilling applications. The bulkhead assembly provides an electrical contact component disposed within a body thereof, wherein at least a portion of the electrical contact component is configured to pivot about its own axis, without compromising its ability to provide a pressure and fluid barrier. A ground apparatus is generally described herein. The ground apparatus may have particular utility with various embodiments of the bulkhead assembly described herein. The ground apparatus provides an electrical connection for at least one ground wire and may be configured to pivot about its own axis when positioned on the bulkhead body of the bulkhead assembly, thereby providing continuous and/or successful electrical contact.

Figure 2:
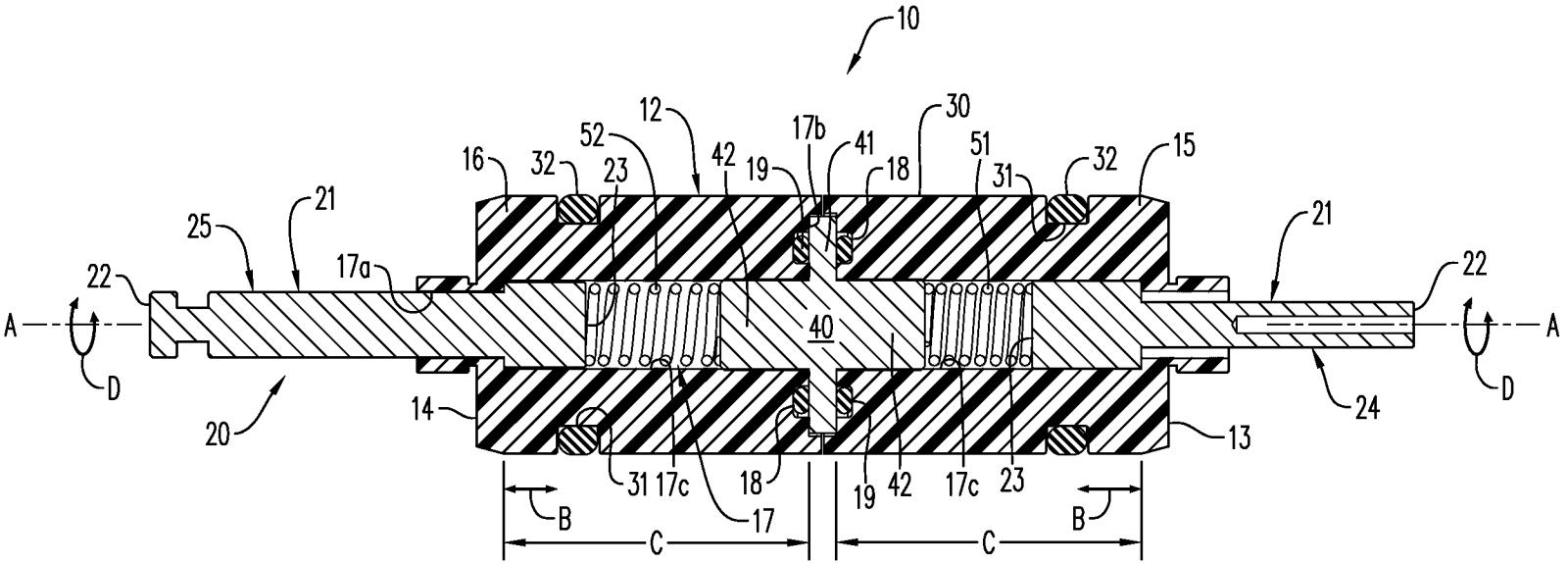
FIG. 2 is a cross-sectional side view of a bulkhead assembly according to an aspect.

With reference to FIG. 2, a bulkhead assembly 10 is provided and is further configured for sealing components positioned downstream of the bulkhead assembly 10 within a downhole tool. In an embodiment, the bulkhead assembly 10 is configured as a pressure-isolating bulkhead and is configured to withstand a pressure of at least about 20,000 psi (137.9 mPa). In an embodiment, the bulkhead assembly 10 is configured to withstand a pressure of at least about 30,000 psi (275.8 mPa). The bulkhead assembly 10 includes a bulkhead body 12 having a first end portion 13 and a second end portion 14 and a bore 17 extending therebetween. It is further envisioned that the bulkhead body 12 includes a first body portion 15 extending from the first end portion 13 towards a center of the bulkhead body 12, and a second body portion 16, extending from the second end portion 14 towards the center of the bulkhead body 12. While it is contemplated that the bulkhead body 12 be made of thermoplastic materials (or otherwise electrically non-conductive materials), it is possible for the bulkhead body 12 to be made of other materials, such as metal (e.g., aluminum with a non-conductive coating). Although the first body portion 15 and the second body portion 16 are depicted as being roughly the same size or otherwise proportioned equally, it is contemplated that these body portions may be dissimilar in size or otherwise disproportionate.

The bulkhead body 12 may be formed as a unitary member or component. Methods of forming the bulkhead body 12 as a unitary member include but are not limited to injection molding and machining the component out of a solid block of material. In an embodiment, the injection molded bulkhead body 12 is formed into a solid material, in which typically a thermoplastic material in a soft or pliable form is allowed to flow around the electrical contact component 20 during the injection molding process.

The bulkhead body 12 includes an outer surface 30, which is configured to be received in a tandem sub 150 as described in greater detail hereinbelow. The outer surface 30 typically includes one or more circumferential indentions 31, which are configured for receiving an outer sealing member 32 in such a way as to seal components positioned downstream of the bulkhead assembly 10 and to withstand typical high pressures experienced in downhole applications.

According to an aspect, the bore 17 extends through the bulkhead body 12, along an axis A-A and typically in the center of the body, and may vary in diameter across the length of the bulkhead body. With particular reference to FIG. 2, the bore 17 may include three sections or portions of varying diameter, although it is possible to configure the bore 17 with one, two, three, or more sections. As depicted in FIG. 2 and in an embodiment, the bore 17 includes an end portion bore 17*a* extending through each of the first body portion 15 and the second body portion 16, a central portion bore 17*b* and mid-portion bores 17*c* extending between the central portion bore 17*b* and the end portion bores 17*a* for a depth or length C. The length C is selected to optimize functionality of the slideable components as described in greater detail hereinbelow. As shown herein and in an embodiment, each end portion bore 17*a* has a smaller radius than the respective mid-portion bore 17*c*, while the central portion bore 17*b* has a larger radius than the mid-portion bores 17*c*.

The bulkhead assembly 10 further includes an electrical contact component 20 extending through the bore 17 of the bulkhead body 12, such that at least a portion of the electrical contact component 20 is configured to pivot about its own axis A-A. Thus, the bulkhead assembly 10 has a pivotable electrical contact component 20. The electrical contact component 20 is configured for electrical conductivity and feed-through of an electric signal. The electrical contact component 20 may thus be formed of any suitable electrically conductive material.

The electrical contact component 20 may include one or more of the following components: a contact pin 21 or wire (not shown), a biasing member 50 (FIG. 3), and/or a central portion 40. It will be understood by one of ordinary skill in the art that although terms like "central" are utilized, such terms are used to describe the positions of some components relative to other components. Although the component may literally be positioned centrally, it is also contemplated that positioning of the components may be de-centralized without detracting from the intended purpose.

Figure 1:
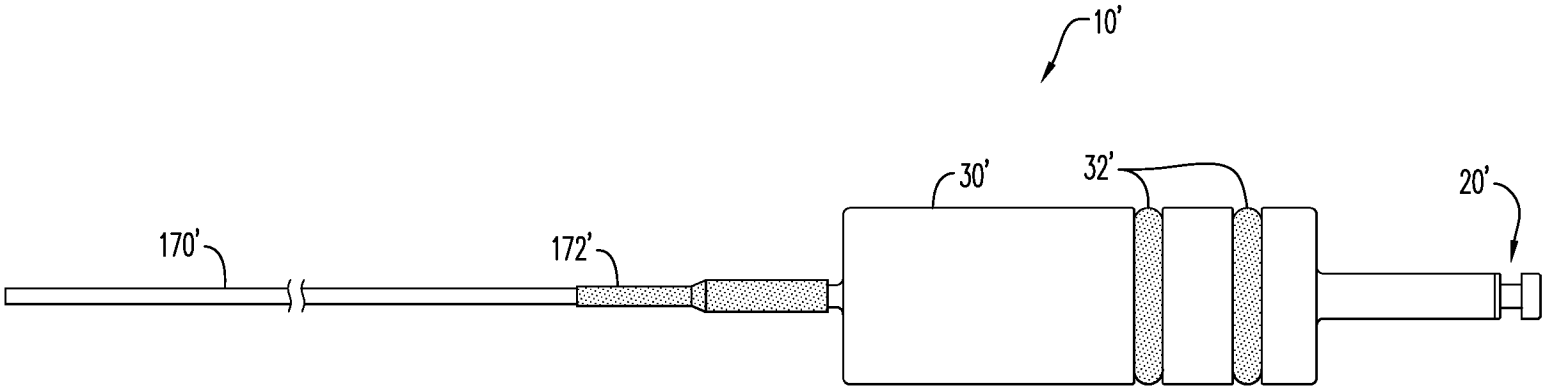
FIG. 1 (PRIOR ART)
FIG. 1 is a perspective view of a bulkhead assembly according to the prior art.

In an embodiment and with particular reference to FIGS. 1 and 2, the electrical contact component 20 includes one or more contact pins 21, a wire connection (not shown) or combinations thereof. In other words, it may be possible to assemble the bulkhead assembly 10 according to an aspect in which a contact pin 21 is replaced by the wire at, for instance a first end 22. Although this may limit the adaptability for the intended use, that is to freely pivot within the bulkhead to avoid binding, crimping or otherwise compromising the wire (and thus an electrical signal), having a single pivotable electrical contact component extending from an end of the bulkhead assembly 10 may still be advantageous over currently available assemblies.

According to an aspect, the electrical contact component 20 may include a plurality of contact pins 21, and each of the contact pins 21 include the first end 22 and a second end 23. In an embodiment, at least one of the contact pins 21 is slidably positioned within the bore 17 of the bulkhead body 12. In an embodiment, the contact pin includes a pin head 26 extending from a pin body 27. Typically, the contact pin may include a terminal contacting portion 28 extending from the pin body 27, opposite the pin head 26 for ease of facilitating the electrical connection.

Figure 3:
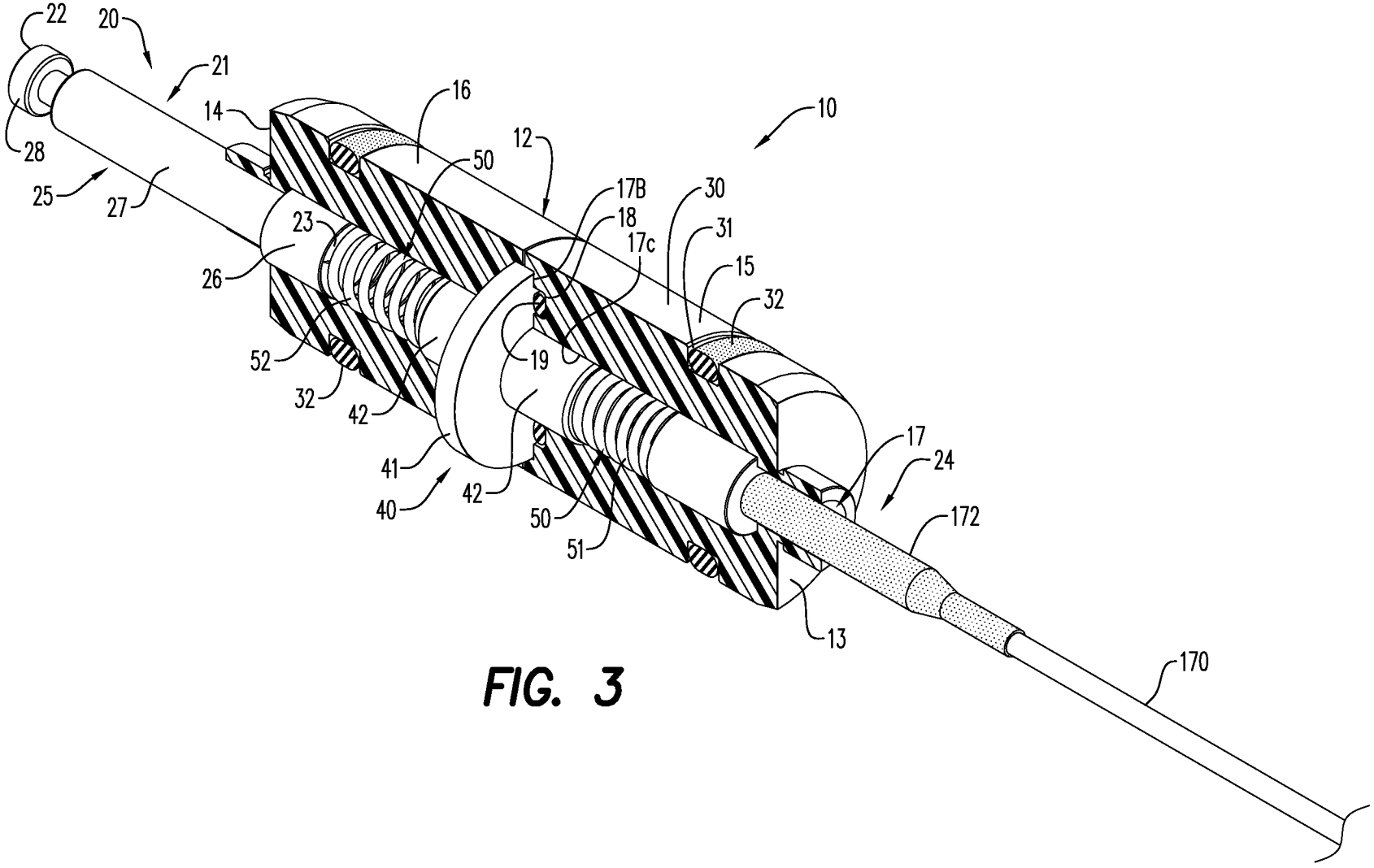
FIG. 3 is a cut-away perspective view of the bulkhead assembly of FIG. 2.

As shown in FIGS. 2 and 3, the bulkhead assembly 10 of the depicted embodiment includes a first contact pin 24 positioned at least partially within the first body portion 15 and extending from the first end portion 13 to an exterior or outer surface 30 of the assembly 10, while a second contact pin 25 is positioned at least partially within the second body portion 16 and extends from the second end portion 14 to the outer surface 30 of the assembly 10.

In an embodiment, the central bore portion 17*b* is typically configured to receive the central portion 40 of the electrical contact component 20, while a mid-portion bore 17*c* is typically configured to receive the pin head 26 and/or the biasing members 50 of the electrical contact component 20. In an embodiment, the central portion 40 and a plurality of biasing members 50 (such as a coil spring) are positioned within the bore 17 of the bulkhead body 12 with the biasing members abutting at least a portion of the central portion 40. In an embodiment, the central portion 40 of the electrical contact component 20 includes a disk-like central body 41 and arms 42 extending therefrom.

As depicted in FIGS. 2 and 3 and in an embodiment, the central portion bore 17*b* of the bore 17 includes a recessed portion 18, which is recessed from the central portion bore and configured to receive a bore sealing member 19. This seal will help to maintain the integrity of the bulkhead assembly 10 for sealing and maintaining pressure across the assembly as described in greater detail hereinbelow.

As shown herein, the plurality of biasing members 50 include a first biasing member 51 and a second biasing member 52. The first biasing member 51 is positioned within the bore 17 of a first body portion 15 of the bulkhead body 12, and the second biasing member 52 is positioned within the bore 17 of a second body portion 16 of the bulkhead body 12. More particularly and in this embodiment, the biasing members 50 are positioned within the mid-portion bore 17*c*. In a further embodiment, the plurality of biasing members 50 abut the central portion 40, and each of said biasing members 50 abuts at least one of the contact pins 21. In an embodiment, the first contact pin 24 abuts the first biasing member 51 and the second contact pin 25 abuts the second biasing member 52. It is further contemplated that it is possible to provide a rigid connection between at least one of the first contact pin 24 and the first biasing member 51 or the second contact pin 25 and the second biasing member 52.

According to an aspect, the pin head 26 of the contact pin is sized to be slidably received within the mid-portion bore 17*c* of the bore 17 of the bulkhead body 12. Thus, in a typical arrangement, the pin head 26 may have an enlarged radius relative to the radius of the pin body 27. In this way, the pin head 26 will be received within the mid-portion 17*c*, while the pin body 27 extends through the end portion bore 17*a* of the first or second end portion 13, 14, respectively.

In operation, the contact pins 21 are capable of rotation or swiveling or twisting or pivoting, (all of which are functions referred to generically herein as "pivot," "pivotable," "pivoting"), about its own axis A-A as shown by arrows D, and are rotatable or pivotable in either direction. This ability to pivot, or to be pivotable, about its own axis can be very useful during the loading procedure of hardware of a downhole tool 100 such as a perforating gun assembly where the twisting of the electrical cable attached to the bulkhead assembly 10 (typically crimped or soldered) would otherwise cause the cable connection to snap off unintentionally. The pivot function described herein allows at least portions of the electrical contact component 20 to pivot without building up tension in the cable to a point of snapping. In addition, the biasing members 50 may also compensate for unfavorable tolerance stack-up in the perforating gun assembly 100.

As shown herein, the axis A-A of the contact pins 21 coincides with the axis A-A of the bulkhead body 12. Furthermore, the contact pins 21 are capable of sliding backwards and forwards in the direction shown by arrows B, and such movement is limited by biasing members 50. In practice, the contact pin is capable of moving into and out of the body while restricted from leaving the bulkhead body 12 due to the smaller inner diameter of end portion bores 17*a*, and compressibility of biasing members 50 as the members 50 are pushed against the central portion 40. It is anticipated that a thickness of each of the first end portion 13 and the second end portion 14 are sized sufficiently to stop or retain at least a portion of the contact pin 21, and in an embodiment, to stop or retain the pin head 26 within the mid-portion bore 17*c*. Alternatively, it may be possible to fix or otherwise attach (rather than abut) each of the components of the electrical contact component 20 together (not shown). In other words, on one end of the electrical contact component 20, the first contact pin 24 may be attached to the first biasing member 51, which is attached to the central portion 40, while at the other end of the component, the second contact pin 25 may be attached to the second biasing member 52, which is attached to the central portion 40. In this way, it may not be necessary to provide first end portion 13 and second end portion 14 to retain the assembly within the bulkhead body 12.

Figure 5:
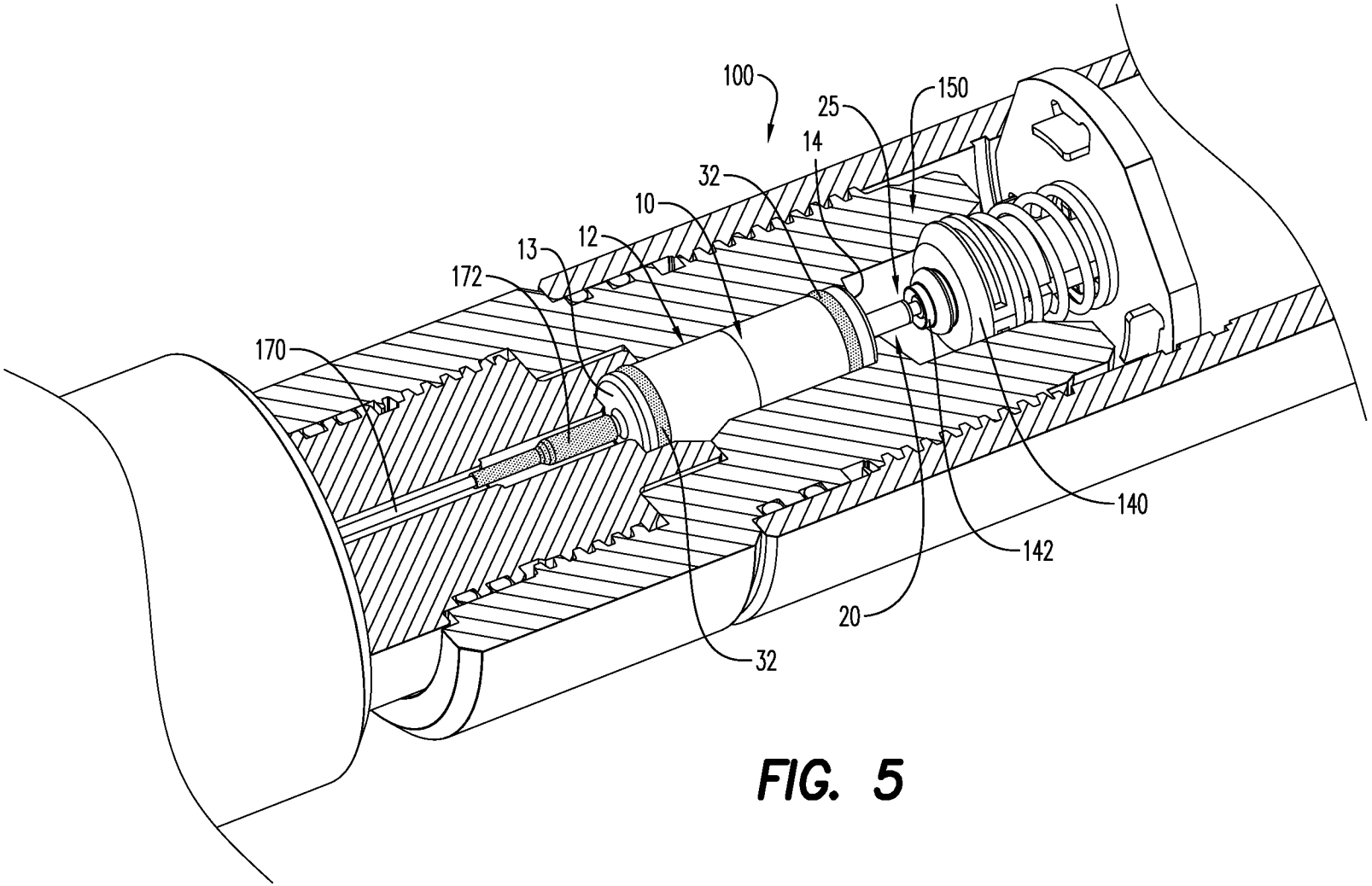
FIG. 5 is a partially cut-away perspective view of the bulkhead assembly assembled within a perforating gun assembly according to an aspect.

In an embodiment, the bulkhead assembly 10 is able to maintain a higher pressure at the first end portion 13 of the bulkhead body 12 as compared to the second end 14 of the bulkhead body 12, as depicted in an embodiment in, for instance, FIG. 5. In this embodiment, the bulkhead assembly 10 is positioned within the downhole tool 100, in this instance a perforating gun assembly. Any and all of the features of the bulkhead assembly 10 mentioned hereinabove are useful in the downhole tool 100 including the bulkhead assembly 10.

Only a portion of the downhole tool 100 is depicted herein, including a tandem seal adapter or tandem sub 150, in which the bulkhead assembly 10 is shown assembled within the perforating gun assembly 100. In an embodiment, the bulkhead assembly 10 is configured for positioning within the tandem seal adaptor 150. The tandem sub 150 is configured to seal inner components within the perforating gun housing from the outside environment using various sealing means. The tandem seal adapter 150 seals adjacent perforating gun assemblies (not shown) from each other, and houses the bulkhead assembly 10. As shown herein, the wired electrical connection 170 is connected to the first end 22 of the electrical contact component 20 of the bulkhead assembly 10 via the first contact pin 24 (not shown). An insulator 172 covers the first contact pin 24 and in an embodiment provides a coating or insulating member, typically using heat shrinking, over the connecting wires of the wired electrical connection 170.

Figure 4:
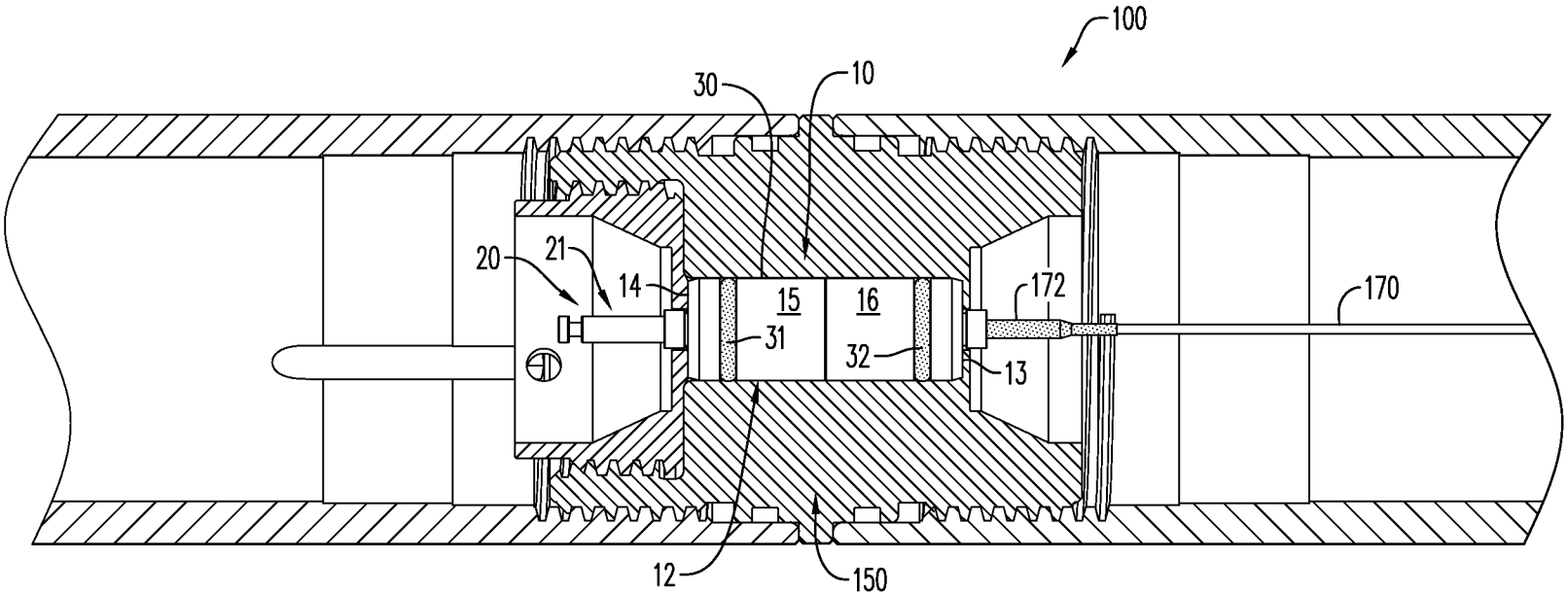
FIG. 4 is a partially cut-away side view of the bulkhead assembly assembled within a perforating gun assembly according to an aspect.

In an embodiment, and as shown particularly in FIGS. 4 and 5, the bulkhead assembly 10 functions to relay the electrical signal via the electrical contact component 20 to an initiator 140, such as a detonator or igniter. In particular and as shown in FIG. 5, the second contact pin 25 is in contact with a spring loaded electric contact, which is connected to the initiator 140. In an embodiment and as shown herein, the first contact pin 24 (see, for instance, FIG. 2, and which is covered by the insulator 172 in FIG. 5) is configured for connecting to the wired electrical connection 170 and the second contact pin 25 is configured for wirelessly electrically contacting an electrical contact, such as a detonator electrical contacting component 142, to transmit the electrical signal. In a further embodiment, the second contact pin 25 is configured for wirelessly electrically contacting an electrical contact of the initiator 140.

Figure 6:
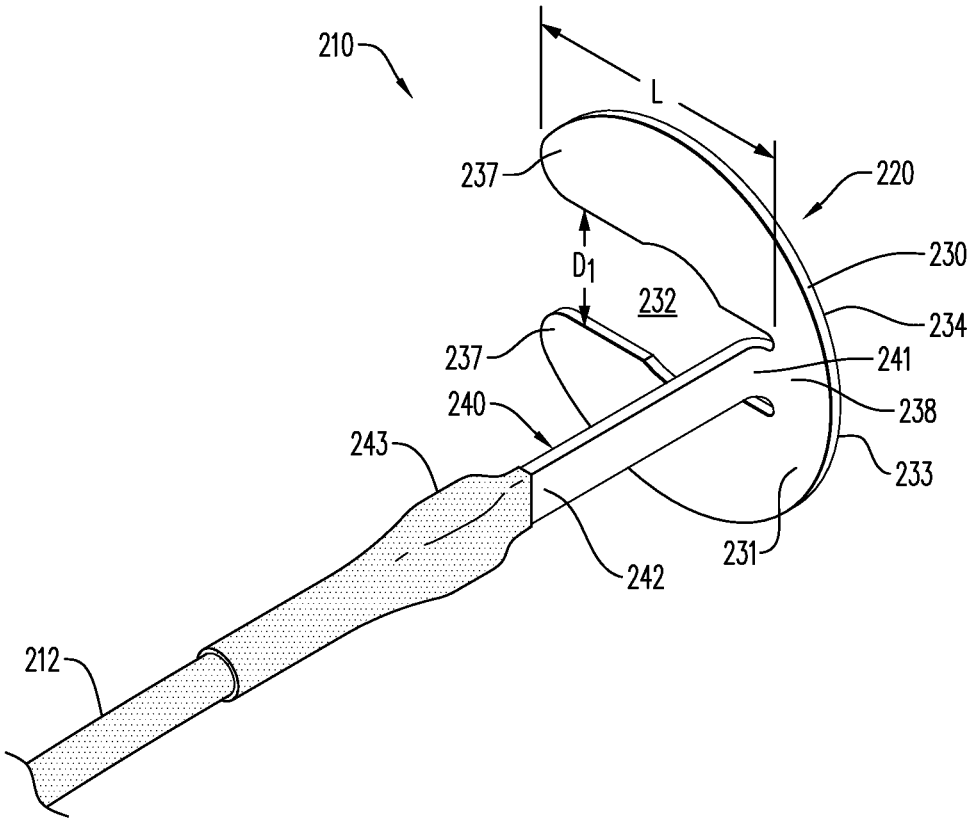
FIG. 6 is a perspective view of a ground apparatus according to an aspect.
Figure 7:
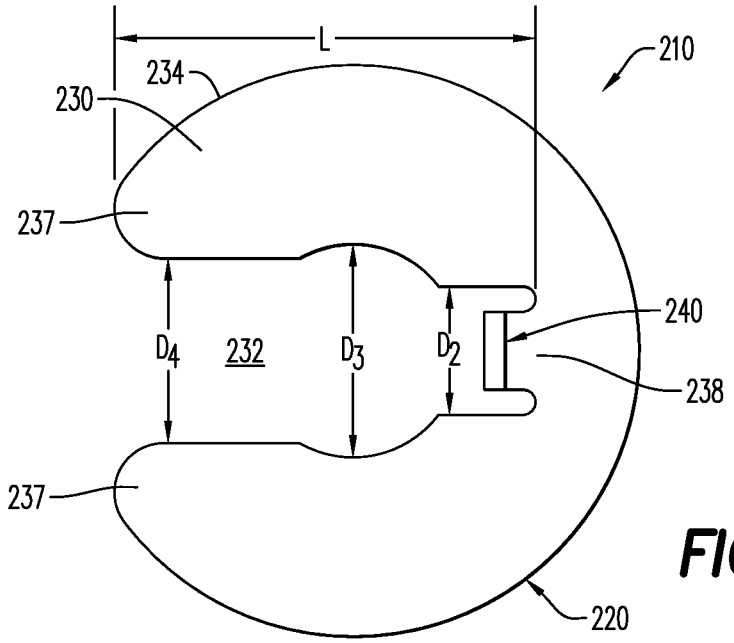
FIG. 7 is a top view of a ground apparatus according to an aspect.
Figure 9A:
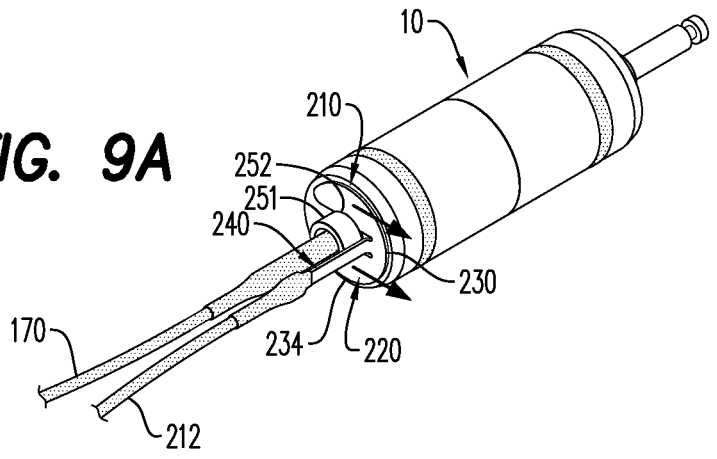
FIGS. 9A-9C are perspective views showing a ground apparatus positioned on a bulkhead assembly according to an aspect.
Figure 9B:
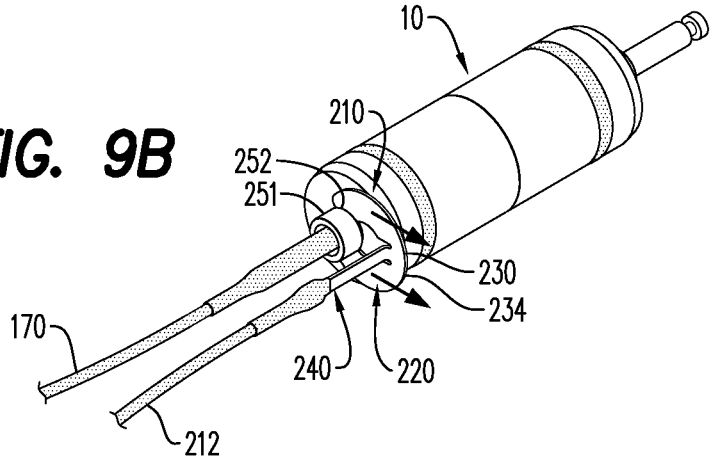
Figure 9C:
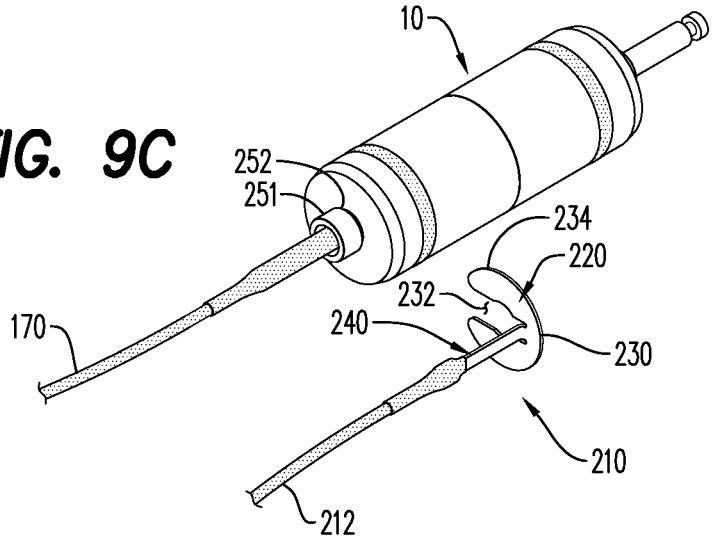

With reference to FIGS. 6-7, a ground apparatus 210 is provided and is configured for providing an electrical connection for at least one ground wire 212. According to an aspect, the ground apparatus may be configured to be received by a receiving member 251 (substantially as shown in FIGS. 9A-9C and described substantially hereinbelow). The ground apparatus 210 may provide a ground apparatus to the electrical contact component of the bulkhead assembly 10 by providing a simple means to ground/attach the ground wire 212. (See, for instance, FIGS. 10-13.)

Figure 12:
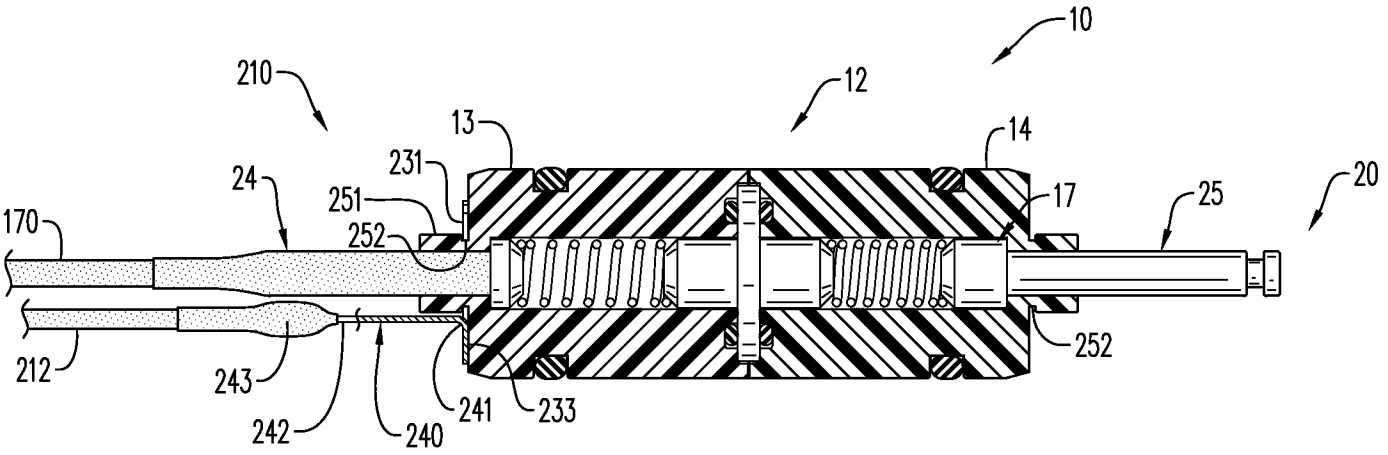
FIG. 12 is a cross-sectional view of a bulkhead assembly having a ground apparatus according to an aspect.

According to an aspect, the ground apparatus 210 may include a plate 220 and a contact arm 240 extending from the plate 220. The plate 220 may include a grounding body 230 including an upper surface 231 and a lower surface 233. According to an aspect, the ground apparatus 210 includes a contact arm 240, which may be formed integrally with and extend from the grounding body 230. While FIG. 6 and FIG. 12 illustrates the contact arm 240 extending out of or away from the upper surface 231, it is to be understood that in some embodiments, the contact arm 240 extends out of or away from the lower surface 233. The contact arm 240 may include an inner portion 241 and an outer portion 242, such that the inner portion 241 extends from the base 238 of the grounding body 230 and the outer portion 242 extends beyond the inner portion 241. The outer portion 242 of the contact arm 240 may include a connecting means 243 for mechanically and electrically connecting to the ground wire 212, thereby providing an electrical ground connection. The connecting means 243 may include, for example, plastic sheathing cables, electrical tape, a clip and insulator, and the like.

According to an aspect and as illustrated in FIG. 7, the plate 220 of the ground apparatus 210 includes at least a semi-disc shape. The plate 220 may have any other shape, such as a rectangular shape. According to an aspect, the plate 220 includes a ductile bendable sheet metal having conductive properties. In an embodiment, the plate 220 includes aluminum, copper, copper alloys and or any other electrically conductive materials. According to an aspect, the contact arm 240 is formed integrally with the grounding body 230 by virtue of being formed from the partially cut or stamped-out section of the grounding body 230.

The grounding body 230 may include an aperture 232. As illustrated in FIG. 7, the grounding body 230 may include the aperture 232 extending from a perimeter 234 of the grounding body 230 substantially inwards and substantially towards a central portion of the grounding body 230. The arrangement and/or formation of the aperture 232 in the grounding body 230 may form fingers 237 on either side of the grounding body 230. The fingers 237 may extend from a base 238 of the grounding body 230. According to an aspect, the fingers 237 extend substantially from the base 238 towards the perimeter 234 of the grounding body 230. In an embodiment, the length L of the fingers 237 defines the depth of the aperture 232 and is the distance from the base 238 of the grounding body 230 to the perimeter 234. The length L may be of any size and shape that would enable the fingers 237 to engage with the receiving member 251, as will be discussed in greater detail hereinbelow. According to an aspect, a distance D1 defines the width of the aperture 232, between the fingers 237. In an embodiment, the distance D1 is created by virtue of the stamped out section of the grounding body 230, i.e., the D1 is substantially same as a size and/or dimensions of the contact arm 240.

With particular reference to FIG. 7, the distance D1 may include an inner distance D2, a central distance D3 and an outer distance D4. According to an aspect, the central distance D3 may have a larger size than the inner distance D2 and/or the outer distance D4. According to an aspect, the central distance D3 may be sized and adapted to provide the pivoting capabilities of the ground apparatus 210. In an embodiment, the central distance D3 is designed to have a substantially circular shape. According to an aspect, when the outer distance D4 is smaller in size than the central distance D3, the outer distance D4 provides retention capabilities when the ground apparatus 210 is snapped or otherwise positioned on, for example, the bulkhead assembly 10 and/or engaged with the receiving member 251, as seen, for instance, in FIG. 9A.

Figure 8:
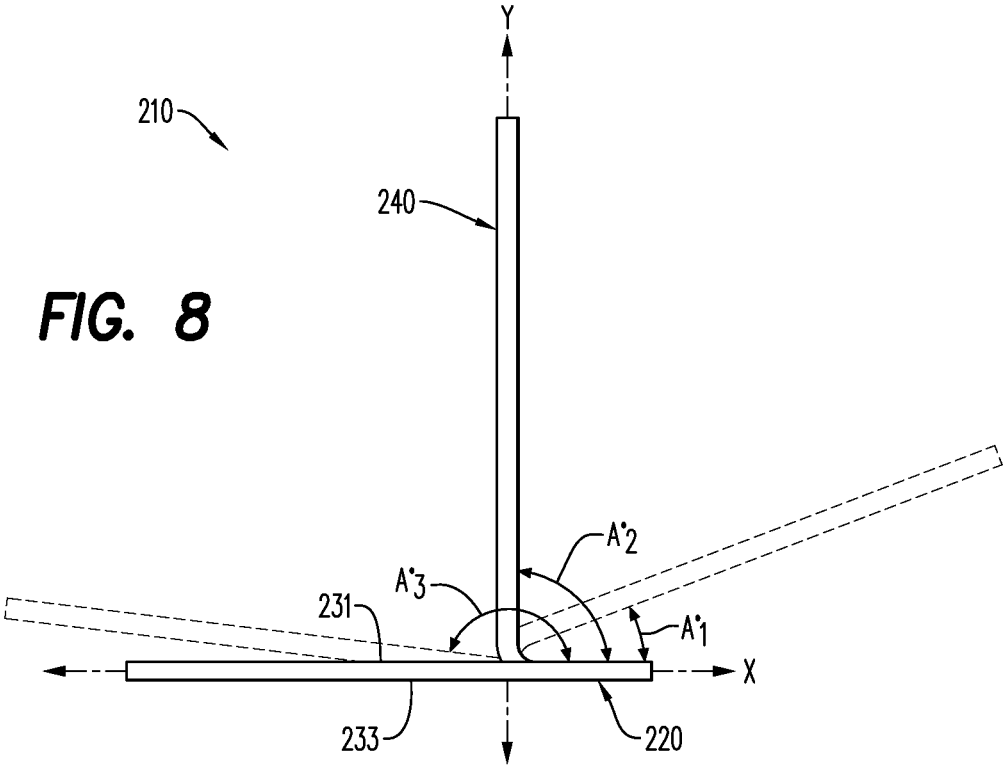
FIG. 8 is a side view of a ground apparatus according to an aspect.

As illustrated in FIG. 8, the contact arm 240 extends from the plate 220, and thus is positioned away from the upper surface 231 of the grounding body 230. According to an aspect, the contact arm 240 projects away from the plate 220 at an angle A°. The angle A° may be between about 10 degrees $A°_1$ and about 170 degrees $A°_3$. According to an aspect, the angle A° is between about 10 degrees $A°_1$ and about 90 degrees $A°_2$. As described hereinabove, the grounding body 230 may be configured for pivoting about its own axis when positioned on the electrical device and/or the receiving member 251. In any event, the angle A° may be selected so that when the grounding body 230 pivots about its own axis, the ground wire 212 will not be torn, twisted and/or crimped/nicked, i.e., the ground wire 212 will not become compromised. In other words, the grounding apparatus 210 may be able to provide continuous and/or successful electrical connection for the ground wire 212 while also being pivotable on the bulkhead assembly 10 and/or the receiving member 251, thereby helping to at least reduce and/or limit the safety issues associated with physically and manually wiring live explosives.

As illustrated in FIGS. 9A-9C and according to an aspect, the ground apparatus 210 is removeably positioned on the receiving member 251 of the bulkhead assembly 10. According to an aspect, the grounding body 230 is at least partially positioned in a groove 252 formed in the receiving member 251. When positioned in the groove 252, the grounding body 230 is pivotable about its own axis. In an embodiment, when the grounding wire 212 is attached to the contact arm 240 of the ground apparatus, the ground apparatus 210 is pivotable in such a manner that the grounding wire 212 will not become compromised. Further, by virtue of being attached to the ground apparatus 210, the grounding wire 212 is also capable of being removeably positioned and/or connected to the receiving member 251.

According to an aspect and as illustrated in FIGS. 9A-9B, when the ground apparatus 210 is positioned on the receiving member 251, the perimeter 234 of the grounding body 230 may have a shape that is substantially similar to the shape of the bulkhead assembly 10. In some embodiments, the perimeter 234 of the grounding body 230 has a shape that is not similar to the shape of the bulkhead assembly 10 (not shown).

FIGS. 9A-9C illustrate the ground apparatus 210 being removed from the receiving member 251, according to an aspect. When the ground apparatus 210 is removed from the receiving member, it can be easily repositioned thereon without requiring additional devices, such as, for example, clips and/or fasteners. The grounding apparatus 210 may function as an integrated device having all the components required for providing continuous and/or successful electrical contact.

With reference to FIGS. 10-13 and according to an aspect, a bulkhead assembly 10 having an integrated ground apparatus is provided. The bulkhead assembly 10 is illustrated including a bulkhead body 12 and an electrical contact component 20. According to an aspect, the bulkhead body 12 includes a first end portion 13, a second end portion 14 and a bore 17 (see FIG. 12) extending between the first end portion 13 and the second end portion 14. The electrical contact component 20 may extend through the bore 17 of the bulkhead body 12, such that at least a portion of the electrical contact component 20 is configured to pivot about its own axis. According to an aspect, the electrical contact component 20 is configured for electrical conductivity and feed-through of the electric signal.

Figure 10:
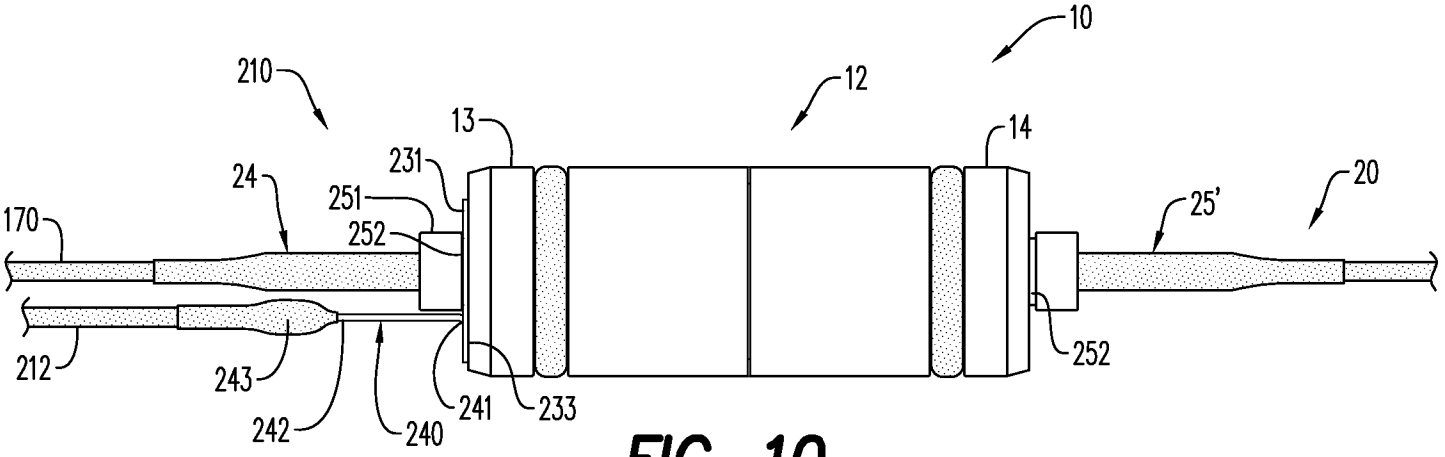
FIG. 10 is a side view of a ground apparatus positioned on a bulkhead assembly for use with a wired initiator, according to an aspect.
Figure 11:
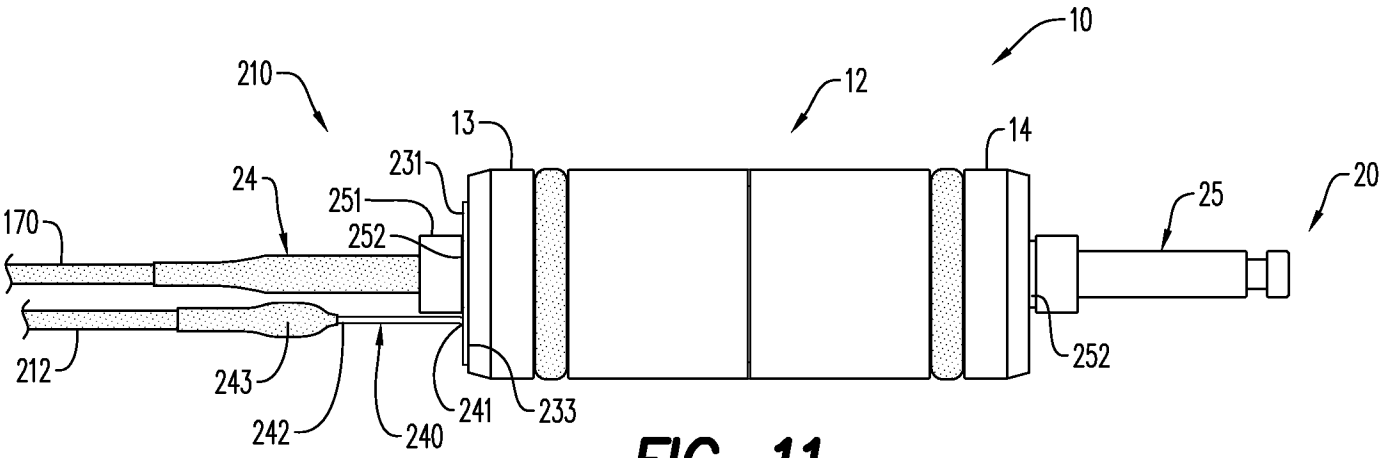
FIG. 11 is a side view of a ground apparatus positioned on a bulkhead assembly for use with a wireless initiator, according to an aspect.

With reference to FIGS. 10-11 and according to an aspect, the bulkhead assembly 10 includes the first contact pin 24 extending from the first end portion 13 and the second contact pin 25, 25' extending from the second end portion 14, with the ground apparatus 210 positioned adjacent to the first end portion 13 of the bulkhead body 12. According to an embodiment, and as illustrated in FIG. 10, the first contact pin 24 is configured for connecting to the wired electrical connection 170 and the second contact pin 25' is configured for providing a wired electrical connection to, for instance, a wired initiator (not shown), to transmit the electrical signal. In an alternative embodiment and as illustrated in FIG. 11, the first contact pin 24 is configured for connecting to the wired electrical connection 170 and the second contact pin 25 is configured for providing a wireless electrical connection to the wireless detonator electrical contacting component 142, (see, for instance, FIG. 5), to complete the electrical connection and to transmit the electrical signal. According to an aspect, when the ground apparatus 210 is positioned within the groove 252 formed in the receiving member 251, the ground apparatus 210 can rotate/swivel/pivot about the receiving member 251 in a manner that does not compromise the grounding wire 212. According to an aspect, the pivot function of the ground apparatus 210 relative to the bulkhead assembly 10 prevents the grounding wire 212 from becoming torn, crimped/nicked, inadvertently disconnected from the receiving member 251, and allows the ground apparatus 210 to pivot or twist around the receiving member 251 as the electrical contact component 20 pivots within the bulkhead body 12 of the bulkhead assembly 10.

Figure 13:
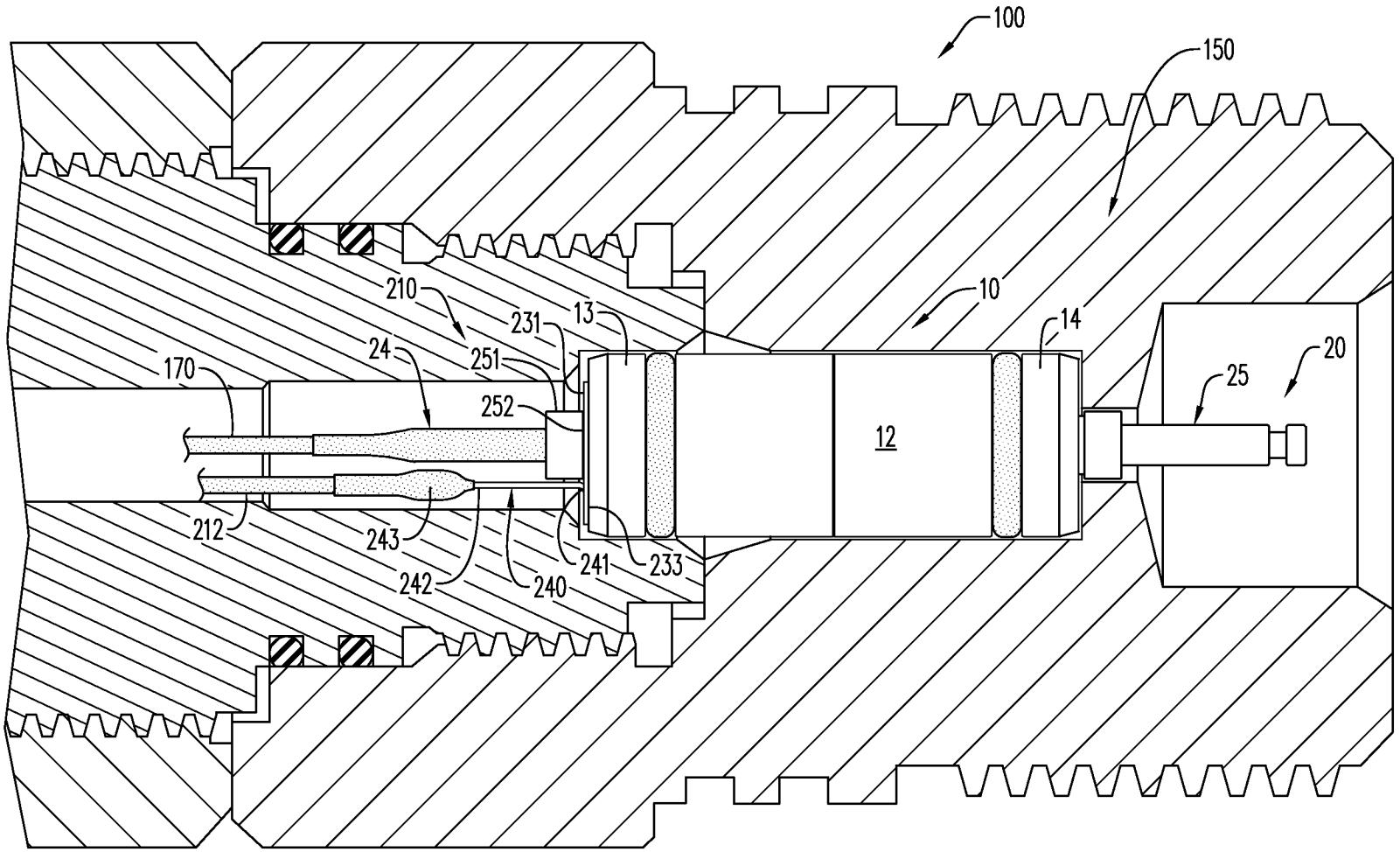
FIG. 13 is a partially cut-away side view a bulkhead assembly having a ground apparatus and assembled within a perforating gun assembly according to an aspect.

FIG. 13 illustrates a downhole tool 100 including the bulkhead assembly 10 having the integrated ground apparatus 210, according to an aspect. The downhole tool 100 may include the tandem seal adapter 150 (FIG. 4) and the ground apparatus 210 pivotally attached to or assembled on the bulkhead assembly 10 within the tandem seal adapter 150, in such a manner that the inner components within the bulkhead assembly 10 are sealed within the tandem seal adapter 150. In other words, the tandem seal adapter 150 may house and seal the bulkhead assembly 10 and its respective ground apparatus 210 from adjacent perforating gun assemblies (not shown).

In an embodiment, the bulkhead assembly 10 provides an improved apparatus for use with a wireless connection—that is, without the need to attach, crimp, cut or otherwise physically and manually connect external wires to the component. Rather, one or more of the connections may be made wirelessly, by simply abutting, for instance, electrically contactable components. For the sake of clarity, the term "wireless" does not refer to a WiFi connection, but rather to this notion of being able to transmit electrical signals through the electrical componentry without connecting external wires to the component.

In an embodiment, the bulkhead assembly 10 is provided that is capable of being placed into the downhole tool 100 with minimal effort. Specifically, bulkhead assembly 10 is configured for use in the downhole tool 100 and to electrically contactably form an electrical connection with the initiator 140 or other downhole device, for instance, to transmit the electrical signal without the need of manually and physically connecting, cutting or crimping wires as required in a wired electrical connection.

Figure 14:
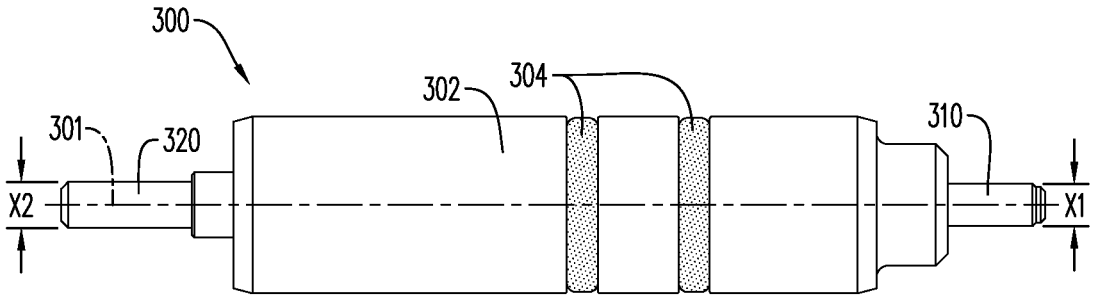
FIG. 14 is a side view of an electrical connector according to an exemplary embodiment.

FIGS. 14-20 illustrate an exemplary embodiment of an electrical connector 300. As seen in FIG. 14, the electrical connector 300 may include a connector body 302 extending along a longitudinal axis 301. The connector body 302 may be formed from thermoplastic materials or otherwise electrically non-conductive materials. Alternatively, the connector body 302 may be made of other materials, such as a metal (e.g., aluminum with a non-conductive coating). O-rings 304 may be provided on an outer surface of the connector body 302. The exemplary embodiment of FIG. 14 shows two o-rings 304, but it will be understood that the number of o-rings 304 may be varied to suit the desired application, such as a single o-ring 304 or three or more o-rings 304. The o-rings 304 are an exemplary embodiment of a sealing member that may be used to help create a pressure barrier in order for the electrical conductor 300 to serve as a pressure-isolating bulkhead in an exemplary embodiment.

FIG. 14 further shows that the electrical connector 300 may include a first electrical contact 310 provided at a first end of the connector body 302 in the longitudinal direction. The first electrical contact 310 may be biased so as to rest at a first rest position if no external force is being applied to the first electrical contact 310 and may be structured so as to move from the first rest position to a first retracted position in response to an application of external force against the first electrical contact 310. In other words, the first electrical contact 310 may be spring-loaded. The first electrical contact 310 may have a first electrical contact diameter X1, and may be dimensioned so that at least a portion of the first electrical contact 310 is positioned in the connector body 302. FIG. 14 shows an exemplary embodiment in which the first electrical contact is formed as a contact pin. However, it will be understood that other forms and shapes may be used for the first electrical contact 310 as may be required for specific applications, including, but not limited to, female electrical contacts and plate contacts.

FIG. 14 further shows that the electrical connector 300 may include a second electrical contact 320 provided at a second end of the connector body 302. The second electrical contact 320 may be biased so as to rest at a second rest position if no external force is being applied to the second electrical contact 320 and may be structured so as to move from the second rest position to a second retracted position in response to an application of external force against the second electrical contact 320. In other words, the second electrical contact 320 may be spring-loaded. The second electrical contact 320 may have a second electrical contact diameter X2, and may be dimensioned so that at least a portion of the second electrical contact 320 is positioned in the connector body 302. FIG. 14 shows an exemplary embodiment in which the second electrical contact is formed as a contact pin. However, it will be understood that other forms and shapes may be used for the second electrical contact 320 as may be required for specific applications, including, but not limited to, female electrical contacts and plate contacts.

Figure 15:
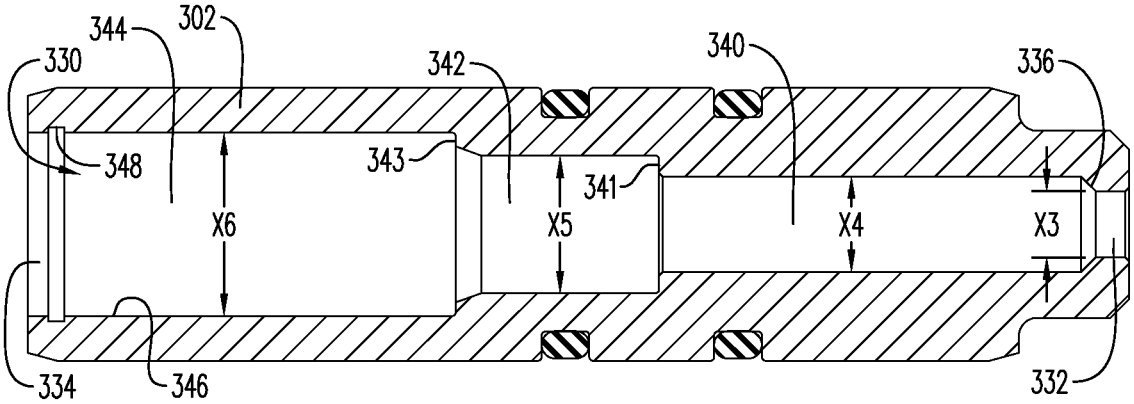
FIG. 15 is a cross-sectional view of a connector body according to an exemplary embodiment.

FIG. 15 shows a cross section of an exemplary embodiment of the connector body 302, the cross section being along a plane that includes the longitudinal axis 301. The connector body 302 may include a bore 330 extending through the length of the connector body 302. The bore 330 may include a first aperture 332 provided at a first end of the bore in the longitudinal direction. The first aperture 332 may have a first aperture diameter X3, which may be larger than the first electrical contact diameter X1. The bore 330 may further include a second aperture 334 provided at a second end of the bore 330 in the longitudinal direction.

The bore 330 may further include a first bore portion 340 provided between the first aperture 332 and the second aperture 334. The first bore portion 340 may be axially adjacent to the first aperture 332. The first bore portion 340 may have a first bore diameter X4. A first bore annular shoulder 336 may be formed at a transition between the first bore portion 340 and the first aperture 332.

The bore 330 may further include a second bore portion 342 provided between the first bore portion 340 and the second aperture 334. The second bore portion 342 may be axially adjacent to the first bore portion 340. The second bore portion 342 may have a second bore diameter X5 that is larger than the first bore diameter X4. A second bore annular shoulder 341 may be formed at a transition between the second bore portion 342 and the first bore portion 340.

The bore may further include a third bore portion 344 provided between the second bore portion 342 and the second aperture 334. The third bore portion 344 may be axially adjacent to the second bore portion 342. The third bore portion 344 may have a third bore diameter X6 that is larger than the second bore diameter X5. A third bore annular shoulder 343 may be provided at a transition between the third bore portion 344 and the second bore portion 342. FIG. 15 further shows that a retainer groove 348 may be formed in an inner surface 346 of the third bore portion 344 at a position between the second bore portion 342 and the second aperture 334. According to an exemplary embodiment, the retainer groove 348 extends along the circumference of the inner surface 346. An exemplary embodiment of retainer groove 348 will be discussed in further detail herein.

Figure 16:
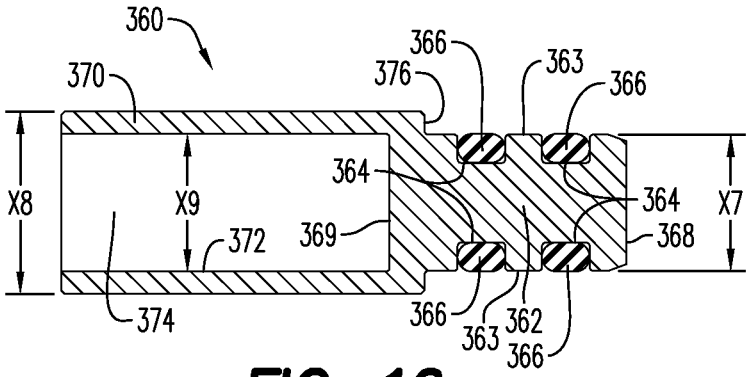
FIG. 16 is a cross-sectional view of a fixed body according to an exemplary embodiment.

FIG. 16 shows a cross section of an exemplary embodiment of a fixed body 360 that may be provided within the bore 330 of the connector body 302, the cross section being along a plane that includes the longitudinal axis 301. The fixed body 360 may be formed of an electrically conductive material. The fixed body 360 may include a first fixed body portion 362. The first fixed body portion 362 may be cylindrical in shape. The first fixed body portion 362 may include grooves 364 provided in an outer circumferential surface 363 of the first fixed body portion 362, and o-rings 366 may be provided in the grooves 364. The exemplary embodiment of FIG. 16 shows two grooves 364 and two o-rings 366, but it will be understood that the number of grooves 364 and o-rings 366 may be varied to suit the desired application, such as a single o-ring 366 or three or more o-rings 366. The o-rings 366 are an exemplary embodiment of a sealing member that may be used to help create a pressure barrier in order for the electrical conductor 300 to serve as a pressure-isolating bulkhead in an exemplary embodiment. The first fixed body portion 362 may have a first fixed body diameter X7 that is larger than the first bore diameter X4 and smaller than the second bore diameter X5.

FIG. 16 further shows that the fixed body 360 may include a second fixed body portion 370. The second fixed body portion 370 may be formed as a hollow cylinder coaxial with and axially adjacent to the first fixed body portion 362. An annular fixed body shoulder 376 may be provided at a transition between the first fixed body portion 362 and the second fixed body portion 370. The second fixed body portion 370 may have a second fixed body diameter X8 that is larger than the second bore diameter X5 and the first fixed body diameter X7, and smaller than the third bore diameter X6. The second fixed body portion 370 may define a fixed body interior space 374 positioned radially inward from the inner circumferential wall 372 of the second fixed body portion 370. The fixed body interior space 374 may have an interior space diameter X9.

FIG. 16 further shows that the fixed body 360 may include a first contact surface 368 provided at a first end of the fixed body in the longitudinal direction and a second contact surface 369 provided within the fixed body interior space 374.

Figure 17:
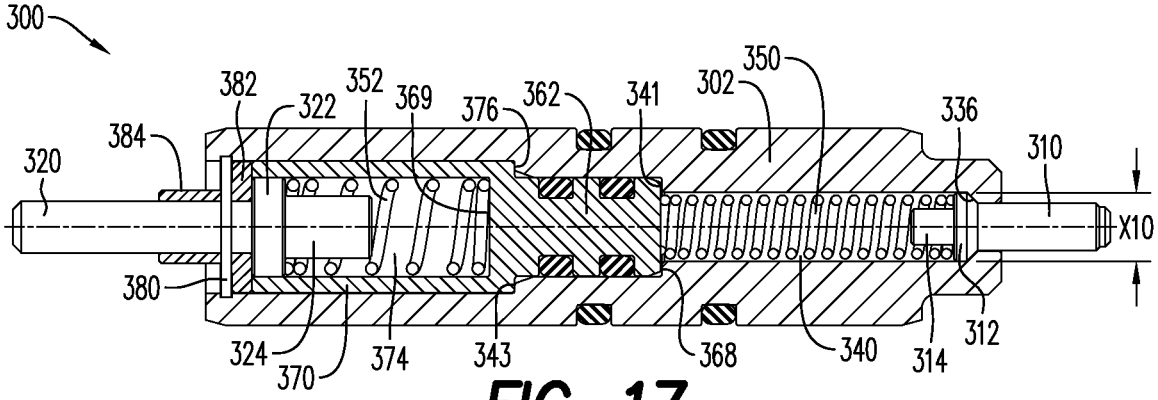
FIG. 17 is a cross-sectional view of an electrical connector at a rest position according to an exemplary embodiment.

FIG. 17 shows a cross section of an assembled electrical connector 300 taken along a plane that includes longitudinal axis 301. As seen in FIG. 17, the fixed body 360 is received within the connector body 302 such that the first fixed body portion 362 is received in the second bore portion 342 and the second fixed body portion 370 is received in the third bore portion 344. The first contact surface 368 may abut the second bore annular shoulder 341 so as to prevent movement of the fixed body 360 in a first direction along the longitudinal axis 301. Alternatively or in addition, the annular fixed body shoulder 376 may abut with the third bore annular shoulder 343 so as to prevent movement of the fixed body 360 in the first direction along the longitudinal axis 301.

In the exemplary embodiment shown in FIG. 17, the first electrical contact 310 may be disposed so as to extend through the first aperture 332. Because the first aperture diameter X3 may be larger than the first electrical contact diameter X1, the first electrical contact 310 may be slidably disposed within the first aperture 332. A first flange 312 may be provided axially adjacent to the first electrical contact 310 and disposed within the first bore portion 340. The first flange 312 may be fixed to the first electrical contact 310. In an exemplary embodiment, the first flange 312 may be integrally or monolithically formed with the first electrical contact 310. The first flange 312 may have a first flange diameter X10, which may be larger than the first aperture diameter X3 (see FIG. 15 for X3). Because the first flange diameter X10 may be larger than the first aperture diameter X3, the first flange 312 cannot pass through the first aperture 332, thereby retaining the first flange 312 within the first bore portion 340. Additionally, the first flange diameter X10 may be smaller than the first bore diameter X4 (see FIG. 15 for X4), so that the first flange 312 may be slidably disposed within the first bore portion 340.

FIG. 17 further shows that, in an exemplary embodiment, a first post 314 may be provided axially adjacent to the first flange 312 and disposed within the first bore portion 340. The first post 314 may have a first post diameter smaller than the first flange diameter X10. The first post 314 may be fixed to the first flange 312. Further, the first post 314 may be integrally or monolithically formed with the first flange 312. In an exemplary embodiment, the first electrical contact 310, the first flange 312, and the first post 314 may be formed of an electrically conductive material.

As further seen in FIG. 17, an exemplary embodiment may include a biasing member such as a first spring 350 provided in the first bore portion 340. The first post 314 may fit inside the first spring 350 such that a first end of the first spring 350 abuts against the first flange 312. A second end of the spring 350 may abut against the first contact surface 368 of the fixed body 362. The first spring 350 may be arranged so as to provide a biasing force that pushes the first flange 312, and consequently, the first electrical contact 310, away from the first contact surface 368. In the exemplary embodiment shown in FIG. 17, there is no external force acting on the first electrical contact 310, so the first spring 350 has extended to a rest position in which the first flange 312 is abutting against the first bore annular shoulder 336. The first spring 350 may be formed of an electrically conductive material. Additionally, as the spring 350 is not necessarily fixed to the first flange 312, the first post 314, or the fixed body 360, it will be understood that the first electrical contact 310 is rotatable with respect to the connector body 302. Even if the first spring 350 were to be fixed to the first electrical contact 310 and the fixed body 360, torsion in the first spring 350 would still allow for at least some rotation of the first electrical contact 310 relative to the connector body 302.

FIG. 17 further shows that a retainer ring 380 may be provided in the third bore portion 344. The retainer ring 380 may fit into the retainer groove 348 show in FIG. 15. The retainer ring 380 may have an outer retainer ring diameter X15 (see FIG. 19) that is larger than the third bore diameter X6, and an inner retainer ring diameter X16 (see FIG. 20). Additionally, a washer 382 may be provided between the fixed body 360 and the retainer ring 380. In an exemplary embodiment, the second fixed body portion 370 may abut with the washer 382 so as to fix the washer 382 between the second fixed body portion 370 and the retainer ring 380. The washer 382 may have an outer washer diameter X12 (see FIG. 19) that is smaller than the third bore diameter X6 such that the washer 382 fits within the third bore portion 344. The outer washer diameter X12 may also be larger than the inner retainer ring diameter X16, such that the washer 382 is retained within the third bore portion 344 by the retainer ring 380. The washer 382 may have an inner washer diameter X13 (see FIG. 30) that is larger than the second electrical contact diameter X2, such that the second electrical contact 320 may be slidably disposed through washer 382. In an exemplary embodiment, the washer 382 may further include a washer sleeve 384 that extends in the longitudinal direction through the retainer ring 380. The washer sleeve 384 may have the same inner washer diameter X13 (see FIG. 20) as the washer 382, and the washer sleeve may have an outer washer sleeve diameter X14 that is smaller than the inner retainer ring diameter X16.

In the exemplary embodiment shown in FIG. 17, the second electrical contact 320 may be disposed so as to extend through the washer 382 and the washer sleeve 384. Because the inner washer diameter X13 is larger than second electrical contact diameter X2, the second electrical contact 320 may be slidably disposed through the washer 382. A second flange 322 may be provided axially adjacent to the second electrical contact and disposed within the fixed body interior space 374. The second flange 322 may be fixed to the second electrical contact 320. In an exemplary embodiment, the second flange 322 may be fixed to the second electrical contact 320. In a further exemplary embodiment, the second flange 322 may be integrally or monolithically formed with the second electrical contact 320. The second flange 322 may have a second flange diameter X11 (see FIG. 19), which may be larger than the inner washer diameter X13. Because the second flange diameter X11 may be larger than the inner washer diameter X13, the second flange 322 cannot pass through the washer 382, thereby retaining the second flange 322 within the fixed body interior space 374. Additionally, the second flange diameter X11 may be smaller than the interior space diameter X9, so that the second flange 322 may be slidably disposed within the fixed body interior space 374.

FIG. 17 further shows that, in an exemplary embodiment, a second post 324 may be provided axially adjacent to the second flange 322 and disposed within the fixed body interior space 374. The second post 324 may have a second post diameter smaller than the second flange diameter X11. The second post 324 may be fixed to the second flange 322. Further, the second post 324 may be integrally or monolithically formed with the second flange 322. In an exemplary embodiment, the second electrical contact 320, the second flange 322, and the second post 324 may be formed of an electrically conductive material.

As further see in FIG. 17, an exemplary embodiment may include a biasing member such as a second spring 352 provided in the fixed body interior space 374. The second post 324 may fit inside the second spring 352 such that a first end of the second spring 352 abuts against the second flange 322. A second end of the spring 352 may abut the second contact surface 369 of the fixed body 362. The second spring 352 may be arranged so as to provide a biasing force that pushes the second flange 322, and consequently, the second electrical contact 320 away from the second contact surface 369. In the exemplary embodiment shown in FIG. 17, there is no external force acting on the second electrical contact 320, so the second spring 352 has extended to a rest position in which the second flange 322 is abutting against the washer 382. The second spring 352 may be formed of an electrically conductive material. Additionally, as the second spring 352 is not necessarily fixed to the second flange 322, the second post 324, or the fixed body 360 it will be understood that the second electrical contact 320 is rotatable with respect to the connector body 302. Even if the second spring 352 were to be fixed to the second electrical contact 320 and the fixed body 360, torsion in the second spring 352 would still allow for at least some rotation of the second electrical contact 320 relative to the connector body 302.

Figure 18:
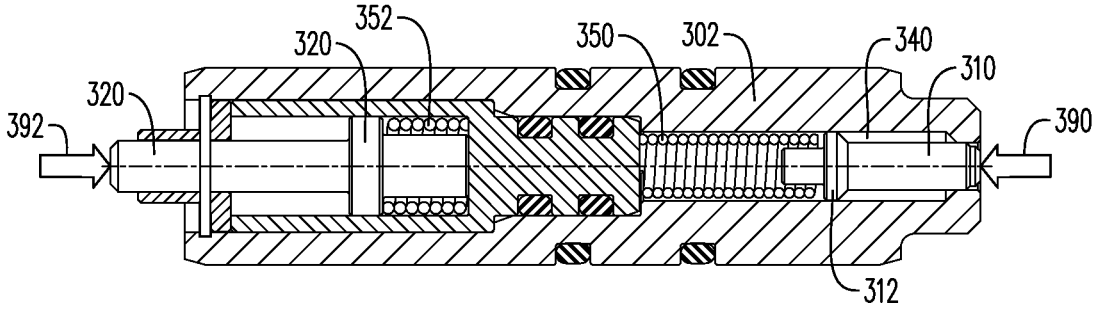
FIG. 18 is a cross-sectional view of an electrical connector at a retracted position according to an exemplary embodiment.
Figure 19:
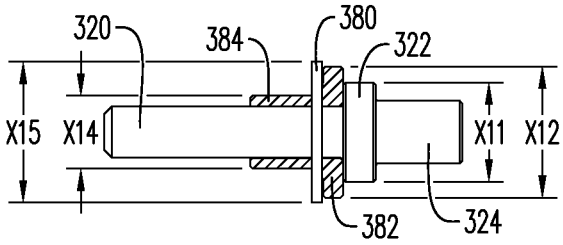
FIG. 19 is a cross-sectional view of an electrical contact, washer, and retainer ring according to an exemplary embodiment.
Figure 20:
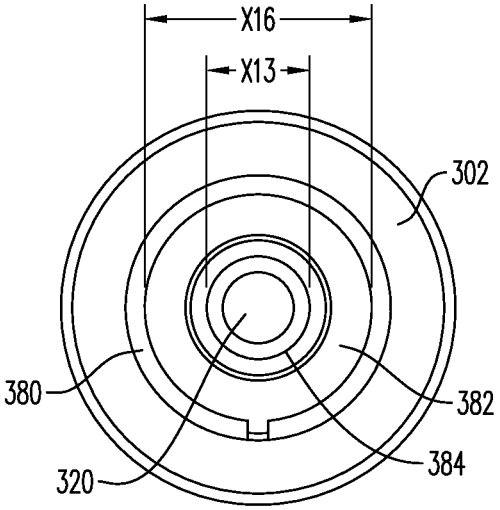
FIG. 20 is an end view of an electrical connector according to an exemplary embodiment.

FIG. 18 shows an exemplary embodiment in which a first external force 390 has been applied to the first electrical contact 310 and a second external force 392 has been applied to the second electrical contact 320. In other words, the first electrical contact 310 and the second electrical contact 320 have been moved to a retracted position due to the first external force 390 and the second external force 392. The first external force 390 and the second external force 392 may represent, for example, other electrical components that have fixed terminals pressing against the first electrical contact 310 and the second electrical contact 320. In FIG. 18, the application of the first external force 390 and the second external force 392 has compressed the first spring 350 and the second spring 352, thereby causing the first electrical contact 310 and the second electrical contact 320 to slide into the connector body 302. The biasing force of the first spring 350 pushes the first electrical contact 310 back against the first external force 390, thereby helping to ensure a secure contact between the first electrical contact 310 and the external contact generating the first external force 390. Similarly, the biasing force of the second spring 352 pushes the second electrical contact 320 back against the second external force 392, thereby helping to ensure a secure contact between the second electrical contact 320 and the external contact generating the second external force 392.

It has been described herein with reference to an exemplary embodiment of the electrical connector 300 that the first electrical contact 310, the first flange 312, the first post 314, the first spring 350, the fixed body 360, the second spring 352, the second post 324, the second flange 322, and the second electrical contact 320 are each made of an electrically conductive material. This allows for electrical conductivity to be provided through the electrical connector 300, thereby helping to provide for feedthrough of electrical signals in a system of perforating guns connected via the electrical connector 300.

Figure 21:
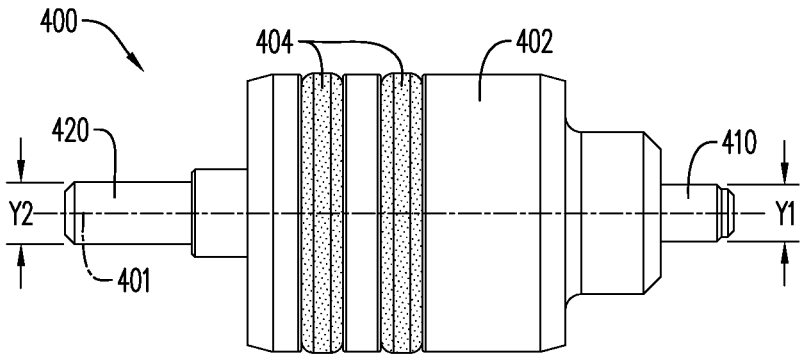
FIG. 21 is a side view of an electrical connector according to an exemplary embodiment.

FIGS. 21-27 illustrate another exemplary embodiment of an electrical connector 400. As seen in FIG. 21, the electrical connector 400 may include a connector body 402 extending along a longitudinal axis 401. O-rings 404 may be provided on an outer surface of the connector body 402. The exemplary embodiment of FIG. 21 shows two o-rings 404, but it will be understood that the number of o-rings 404 may be varied to suit the needs of the desired application, such as a single o-ring 404 or three or more o-rings 404. The o-rings 404 are an exemplary embodiment of a sealing member that may be used to help create a pressure barrier in order for the electrical conductor 400 to serve as a pressure-isolating bulkhead in an exemplary embodiment.

FIG. 21 further shows that the electrical connector 400 may include a first electrical contact 410 provided at a first end of the connector body 402 in the longitudinal direction. The first electrical contact 410 may be biased so as to rest at a first rest position if no external force is being applied to the first electrical contact 410. The first electrical contact 410 may be structured so as to move from the first rest position to a first retracted position in response to an application of external force against the first electrical contact 410. In other words, the first electrical contact 410 may be spring-loaded. The first electrical contact 410 may have a first electrical contact diameter Y1. FIG. 21 shows an exemplary embodiment in which the first electrical contact 410 is formed as a contact pin. However, it will be understood that other forms and shapes may be used for the first electrical contact 410 as may be required for specific applications, including, but not limited to, female electrical contacts and plate contacts.

FIG. 21 further shows that the electrical connector 400 may include a second electrical contact 420 provided at a second end of the connector body 402. The second electrical contact 420 may be biased so as to rest at a second rest position if no external force is being applied to the second electrical contact 420. The second electrical contact 420 may be structured so as to move from the second rest position to a second retracted position in response to an application of external force against the second electrical contact 420. In other words, the second electrical contact may be spring loaded. The second electrical contact 420 may have a second electrical contact diameter Y2. FIG. 21 shows an exemplary embodiment in which the second electrical contact 420 is formed is formed as a contact pin. However, it will be understood that other forms and shapes may be used for the second electrical contact 420 as bay be required for specific applications, including, but not limited to, female electrical contacts and plate contacts.

Figure 22:
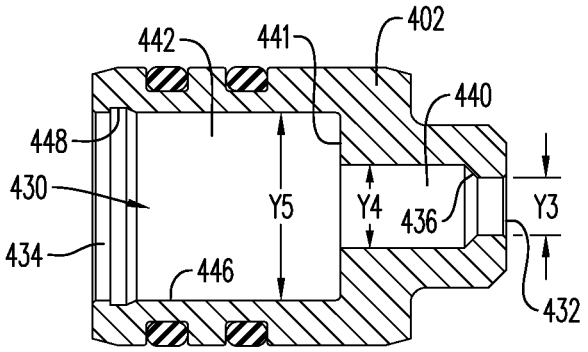
FIG. 22 is a cross-sectional view of a connector body according to an exemplary embodiment.

FIG. 22 shows a cross section of an exemplary embodiment of the connector body 402, the cross section being along a plane that includes the longitudinal axis 401. The connector body 402 may include a bore 430 extending through the length of the connector body 402. The bore 430 may include a first aperture 432 provided at a first end of the bore 430 in the longitudinal direction. The first aperture 432 may have a first aperture diameter Y3, which may be larger than the first electrical contact diameter Y1. The bore 430 may further include a second aperture 434 provided at a second end of the bore 430 in the longitudinal direction.

The bore 430 may further include a first bore portion 440 provided between the first aperture 432 and the second aperture 434. The first bore portion 440 may be axially adjacent to the first aperture 432. The first bore portion 440 may have a first bore diameter Y4. A first bore annular shoulder 436 may be formed at a transition between the first bore portion 440 and the first aperture 432.

The bore may further include a second bore portion 442 provided between the first bore portion 440 and the second aperture 434. The second bore portion 442 may be axially adjacent to the first bore portion 440. The second bore portion 342 may have a second bore diameter Y5 that is larger than the first bore diameter Y4. A second bore annular shoulder 441 may be formed at a transition between the second bore portion 442 and the first bore portion 440. FIG. 22 further shows that a retainer groove 448 may be formed in an inner circumferential surface 446 of the second bore portion 442 at a position between the first bore portion 440 and the second aperture 434. An exemplary embodiment of retainer groove 448 will be discussed in further detail herein.

Figure 23:
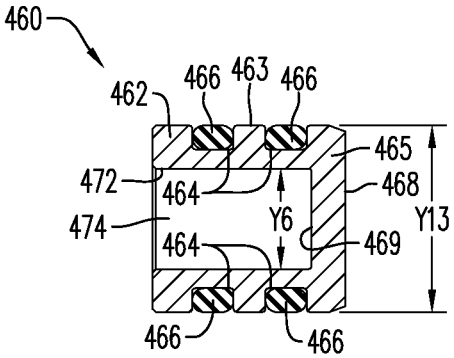
FIG. 23 is a cross-sectional view of a fixed body according to an exemplary embodiment.

FIG. 23 shows a cross section of an exemplary embodiment of a fixed body 460 that may be provided within the bore 430 of the connector body 402, the cross section being along a plane that includes the longitudinal axis 401. The fixed body 460 may be formed of an electrically conductive material. The fixed body 460 may include a hollow cylinder 462 that is capped by a plate 465 at a first end of the hollow cylinder 462. The fixed body 460 may have a fixed body diameter Y13, which may be larger than the first bore diameter Y4 and smaller than the second bore diameter Y5. The hollow cylinder 462 may define a fixed body interior space 474 positioned radially inward from the inner circumferential walls 472 of the hollow cylinder 462. The fixed body interior space 474 may have an interior space diameter Y6. The fixed body 460 may include grooves 464 provided in an outer circumferential surface 463 of the fixed body 460, and o-rings 466 may be provided in the grooves 464. The exemplary embodiment of FIG. 23 shows two grooves 464 and two o-rings 466, but it will be understood that the number of the grooves 464 and the o-rings 466 may be varied to suit the desired application, such as a single o-ring 466 or three or more o-rings 466. Additionally, while FIG. 23 shows that the o-rings 466 are provided on an outer peripheral surface of hollow cylinder 462, it will be understood that the one or more o-rings 466 may be provided on an outer peripheral surface of plate 465, provided plate 465 has sufficient thickness in the longitudinal direction of fixed body 460. The o-rings 466 are an exemplary embodiment of a sealing member that may be used to help create a pressure barrier in order for the electrical conductor 400 to serve as a pressure-isolating bulkhead in an exemplary embodiment. FIG. 23 further shows that the plate 465 may have a first plate surface 468 and a second plate surface 469 opposite to the first plate surface 468.

Figure 24:
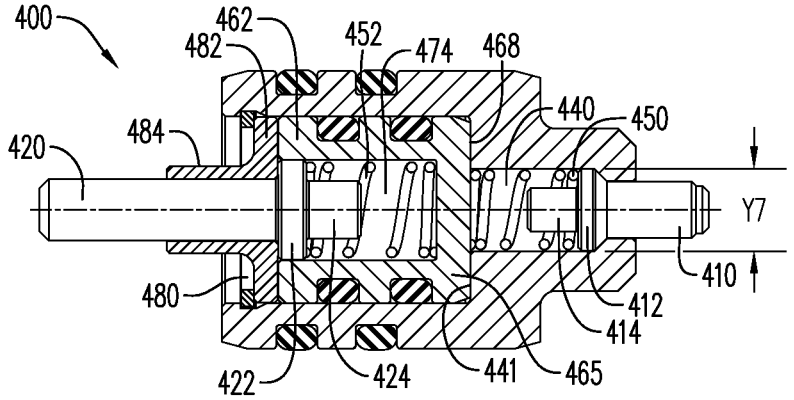
FIG. 24 is a cross-sectional view of an electrical connector at a rest position according to an exemplary embodiment.

FIG. 24 shows a cross section of an assembled electrical connector 400 taken along a plane that include longitudinal axis 301. As seen in FIG. 24, the fixed body 460 is received within the second bore portion 442 of the connector body 402. The first plate surface 468 may abut the second bore annular shoulder 441 so as to prevent movement of the fixed body 460 in a first direction along the longitudinal axis 401.

In the exemplary embodiment shown in FIG. 24, the first electrical contact 410 may be disposed so as to extend through the first aperture 432. Because the first aperture diameter Y3 may be larger than the first electrical contact diameter Y1, the first electrical contact 410 may be slidably disposed within the first aperture 432. A first flange 412 may be provided axially adjacent to the first electrical contact 410 and disposed within the first bore portion 440. The first flange 412 may be fixed to the first electrical contact 410. In an exemplary embodiment the first flange 412 may be integrally or monolithically formed with the first electrical contact 410. The first flange 412 may have a first flange diameter Y7, which may be larger than the first aperture diameter Y3. Because the first flange diameter Y7 may be larger than the first aperture diameter Y3, the first flange 412 cannot pass through the first aperture 432, thereby retaining the first flange 412 within the first bore portion 440. Additionally, the first flange diameter Y7 may be smaller than the first bore diameter Y4, so that the first flange 412 may be slidably disposed within the first bore portion 440.

FIG. 24 further shows that, in an exemplary embodiment, a first post 414 may be provided axially adjacent to the first flange 412 and disposed within the first bore portion 440. The first post 414 may have a first post diameter smaller than the first flange diameter Y7. The first post 414 may be fixed to the first flange 412. Further, the first post 414 may be integrally or monolithically formed with the first flange 412. In an exemplary embodiment, the first electrical contact 410, the first flange 412, and the first post 414 may be formed of an electrically conductive material.

As further seen in FIG. 24, an exemplary embodiment may include a biasing member such as a first spring 450 provided in the first bore portion 440. The first post 414 may fit inside the first spring 450 such that a first end of the first spring 450 abuts against the first flange 412. A second end of the spring 350 may abut against the first plate surface 468 of the fixed body 460. The first spring 450 may be arranged so as to provide a biasing force that pushes the first flange 412, and consequently, the first electrical contact 410, away from the first plate surface 368. In the exemplary embodiment shown in FIG. 24, there is no external force acting on the first electrical contact 410, so the first spring 450 has extended to a rest position in which the first flange 412 is abutting against the first bore annular shoulder 436. The first spring 450 may be formed of an electrically conductive material. Additionally, as the spring 450 is not necessarily fixed to the first flange 412, the first post 414, or the fixed body 460, it will be understood that the first electrical contact 410 is rotatable with respect to the connector body 402. Even if the first spring 450 were to be fixed to the first electrical contact and the fixed body 460, torsion in the first spring 450 would still allow for at least some rotation of the first electrical contact 410 relative to the connector body 402.

FIG. 24 further shows that a retainer ring 480 may be provided in the second bore portion 442. The retainer ring 480 may first into the retainer groove 448 shown in FIG. 22. The retainer ring 480 may have an outer retainer ring diameter Y8 (see FIG. 26) that is larger than the second bore diameter Y5, and an inner retainer ring diameter Y9 (see FIG. 27). Additionally, a washer 482 may be provided between the fixed body 460 and the retainer ring 480. In an exemplary embodiment the fixed body 460 may abut with the washer 482 so as to fix the washer 482 between the fixed body 460 and the retainer ring 480. The washer 482 may have an outer washer diameter Y11 (see FIG. 26) that is smaller than the second bore diameter Y5 such that the washer 482 fits within the second bore portion 442. The outer washer diameter Y11 may also be larger than the inner retainer ring diameter Y9 such that the washer 482 is retained within the second bore portion 442 by the retainer ring 480. The washer 482 may have an inner washer diameter Y10 (see FIG. 27) that is larger than the second electrical contact diameter Y2, such that the second electrical contact 420 may be slidably disposed through washer 482. In an exemplary embodiment, the washer 482 may further include a washer sleeve 484 that extends in the longitudinal direction through the retainer ring 480. The washer sleeve 484 may have the same inner washer diameter Y10 as the washer 482, and the washer sleeve may have an outer washer sleeve diameter Y14 that is smaller than the inner retainer ring diameter Y9.

In the exemplary embodiment shown in FIG. 24, the second electrical contact 420 may be disposed so as to extend through the washer 482 and the washer sleeve 484. Because the inner washer diameter Y10 is larger than the second electrical contact diameter Y2, the second electrical contact 420 may be slidably disposed through the washer 482 and the washer sleeve 484. A second flange 422 may be provided axially adjacent to the second electrical contact and disposed within the fixed body interior space 474. The second flange 422 may be fixed to the second electrical contact 420. In an exemplary embodiment, the second flange 422 may be fixed to the second electrical contact 420. In a further exemplary embodiment, the second flange 422 may be integrally or monolithically formed with the second electrical contact 420. The second flange 422 may have a second flange diameter Y12 (see FIG. 26), which may be larger than the inner washer diameter Y10. Because the second flange diameter Y12 may be larger than the inner washer diameter Y10, the second flange 422 cannot pass through the washer 482, thereby retaining the second flange 422 within the fixed body interior space 474. Additionally, the second flange diameter Y12 may be smaller than the interior space diameter Y6, so that the second flange 422 may be slidably disposed within the fixed body interior space 474.

FIG. 24 further shows that, in an exemplary embodiment, a second post 424 may be provided axially adjacent to the second flange 422 and disposed within the fixed body interior space 474. The second post 424 may have a second post diameter smaller than the second flange diameter Y12. The second post 424 may be fixed to the second flange 422. Further, the second post 424 may be integrally or monolithically formed with the second flange 422. In an exemplary embodiment, the second electrical contact 420, the second flange 422, and the second post 424 may be formed of an electrically conductive material.

As further seen in FIG. 24, an exemplary embodiment may include a biasing member such as a second spring 452 provided in the fixed body interior space 474. The second post 424 may fit inside the second spring 452 such that a first end of the second spring 452 abuts against the second flange 422. A second end of the spring 452 may abut the second plate surface 469 of the plate 465. The second spring 452 may be arranged so as to provide a biasing force that pushes the second flange 422, and consequently, the second electrical contact 420 away from the second plate surface 469. In the exemplary embodiment shown in FIG. 24, there is no external force acting on the second electrical contact 420, so the second spring 452 has extended to a rest position in which the second flange 422 is abutting against the washer 482. The second spring 452 may be formed of an electrically conductive material. Additionally, as the second spring 452 is not necessarily fixed to the second flange 422, the second post 424, or the fixed body 360, it will be understood that the second electrical contact 420 is rotatable with respect to the connector body 402. Even if the second spring 452 were to be fixed to the second electrical contact 420 and the fixed body 360, torsion in the second spring 452 would still allow for at least some rotation of the second electrical contact 420 relative to the connector body 402.

Figure 25:
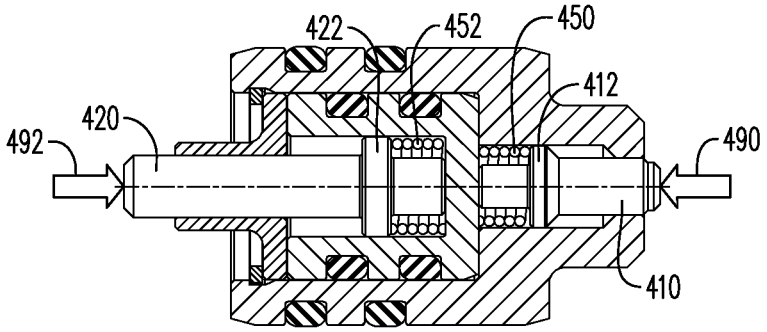
FIG. 25 is a cross-sectional view of an electrical connector at a retracted position according to an exemplary embodiment.
Figure 26:
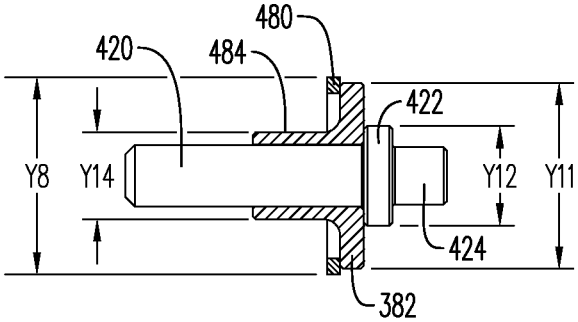
FIG. 26 is a cross-sectional view of an electrical contact, washer, and retainer ring according to an exemplary embodiment.
Figure 27:
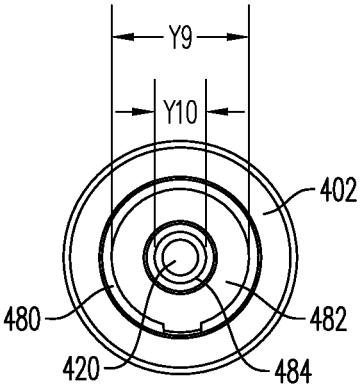
FIG. 27 is an end view of an electrical connector according to an exemplary embodiment.

FIG. 25 shows an exemplary embodiment in which a first external force 490 has been applied to the first electrical contact 410 and a second external force 492 has been applied to the second electrical contact 420. In other words, the first electrical contact 410 and the second electrical contact 420 have been moved to a retracted position due to the first external force 490 and the second external force 492. The first external force 490 and the second external force 492 may represent, for example, other electrical components that have fixed terminals against the first electrical contact 410 and the second electrical contact 420. In FIG. 25, the application of the first external force 490 and the second external force 492 has compressed the first spring 450 and the second spring 452, thereby causing the first electrical contact 410 and the second electrical contact 420 to slide into the connector body 402. The biasing force of the first spring 450 pushes the first electrical contact 410 back against the first external force 490, thereby helping to ensure a secure contact between the first electrical contact 410 and the external contact generating the first external force 490. Similarly, the biasing force of the second spring 452 pushes the second electrical contact 420 back against the second external force 492, thereby helping to ensure a secure contact between the second electrical contact 420 and the external contact generating the second external force 492.

Figure 28:
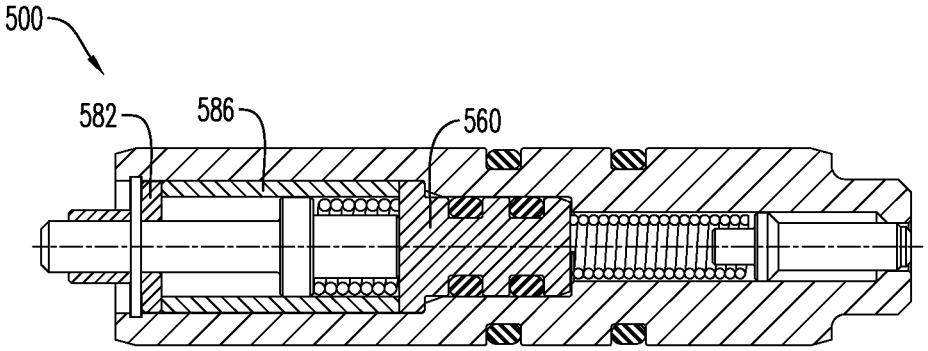
FIG. 28 is a cross-sectional view of an electrical connector according to an exemplary embodiment.
Figure 29:
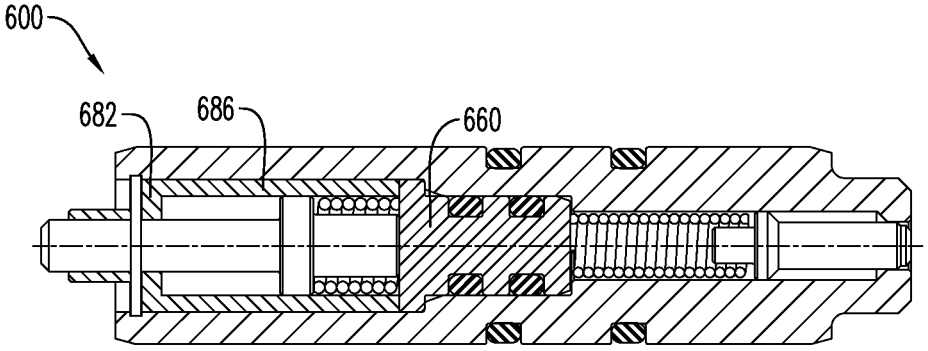
FIG. 29 is a cross-sectional view of an electrical connector according to an exemplary embodiment.

While the exemplary embodiment of FIG. 17 shows the second fixed body portion 370 monolithically formed with the first fixed body portion 362, it will be understood that alternative embodiments are possible. For example, in another exemplary embodiment of an electrical connector 500 shown in FIG. 28, a spacer 586 may be provided between a fixed body 560 and a washer 582. The spacer 586 may be shaped as a hollow cylinder, and may be formed of a material such as a plastic or resin that could be injection molded or 3-D printed. Alternatively, FIG. 29 shows an exemplary embodiment of an electrical connector 600 in which a hollow cylinder 686 is integrally and/or monolithically formed with washer 682. Hollow cylinder 686 may extend in a longitudinal direction to abut with fixed body 660.

The components and methods illustrated are not limited to the specific embodiments described herein, but rather, features illustrated or described as part of one embodiment can be used on or in conjunction with other embodiments to yield yet a further embodiment. Such modifications and variations are intended to be included. Further, steps described in the method may be utilized independently and separately from other steps described herein.

While the apparatus and method have been described with reference to preferred embodiments, it will be understood by those skilled in the art that various changes may be made and equivalents may be substituted for elements thereof without departing from the scope. In addition, many modifications may be made to adapt a particular situation or material to the teachings without departing from the essential scope thereof. In the interest of brevity and clarity, and without the need to repeat all such features, it will be understood that any feature relating to one embodiment described herein in detail, may also be present in an alternative embodiment. As an example, it would be understood by one of ordinary skill in the art that if the electrical contact component 20 of one embodiment is described as being formed of an electrically conductive material, that the electrical contact component 20 described in the alternative embodiment is also formed of an electrically conductive material, without the need to repeat all such features.

In this specification and the claims that follow, reference will be made to a number of terms that have the following meanings. The singular forms "a," "an" and "the" include plural referents unless the context clearly dictates otherwise. Furthermore, references to "one embodiment" are not intended to be interpreted as excluding the existence of additional embodiments that also incorporate the recited features. Terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples, including the best mode, and also to enable any person of ordinary skill in the art to practice, including making and using any devices or systems and performing any incorporated methods. The patentable scope is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical connector comprising:

a connector body extending along a longitudinal axis;

a first electrical contact provided at a first end of the connector body;

a first aperture provided in the first end of the connector body;

a bore provided in an interior of the connector body, the bore being connected to the first aperture;

a conductive fixed body provided within the bore, the conductive fixed body comprising a first contact surface on a first side of the conductive fixed body facing the first electrical contact along the longitudinal axis; and a first spring provided in the bore between the first contact surface and the first electrical contact, the first spring being in contact with the first contact surface and the first electrical contact.

2. The electrical connector of claim 1, wherein a position of the conductive fixed body is fixed relative to the connector body.

3. The electrical connector of claim 1, wherein the first electrical contact is a first contact pin extending through the first aperture.

4. The electrical connector of claim 3, wherein:

the first contact pin comprises a first flange disposed within the bore; and a diameter of the first flange is larger than a diameter of the first aperture.

5. The electrical connector of claim 4, wherein the first spring abuts the first flange.

6. The electrical connector of claim 1, wherein the first electrical contact is rotatable around the longitudinal axis with respect to the connector body.

7. The electrical connector of claim 1, further comprising a first o-ring provided between the conductive fixed body and the connector body in a radial direction perpendicular to the longitudinal axis.

8. The electrical connector of claim 1, further comprising a first o-ring provided on an outer surface of the connector body.

9. The electrical connector of claim 1, wherein the conductive fixed body further comprises:

a first fixed body portion having a first fixed body diameter; and a second fixed body portion axially adjacent to the first fixed body portion and having a second fixed body diameter larger than the first fixed body diameter.

10. The electrical connector of claim 1, wherein the first contact surface of the conductive fixed body is substantially perpendicular to the longitudinal axis.

11. An electrical connector comprising:

a connector body extending along a longitudinal axis;

a first electrical contact provided at a first end of the connector body;

a second electrical contact provided at a second end of the connector body;

a first aperture provided in the first end of the connector body;

a second aperture provided in the second end of the connector body;

a bore provided in an interior of the connector body, the bore being connected to the first aperture;

a conductive fixed body provided within the bore, the conductive fixed body comprising a first contact surface on a first side of the conductive fixed body facing the first electrical contact along the longitudinal axis;

a second contact surface provided on a second side of the conductive fixed body facing the second electrical contact along the longitudinal axis;

a first spring provided in the bore between the first contact surface and the first electrical contact, the first spring being in contact with the first contact surface and the first electrical contact; and a second spring provided in the bore between the second contact surface and the second electrical contact, the second spring being in contact with the second contact surface and the second electrical contact.

12. The electrical connector of claim 11, wherein the second electrical contact is a second contact pin extending through the second aperture.

13. The electrical connector of claim 11, wherein:

the conductive fixed body further comprises:

a first fixed body portion having a first fixed body diameter; and a second fixed body portion axially adjacent to the first fixed body portion and having a second fixed body diameter larger than the first fixed body diameter;

the second fixed body portion comprises a fixed body interior space;

the second contact surface is provided within the fixed body interior space; and at least a portion of the second spring is provided within the fixed body interior space.

14. The electrical connector of claim 11, wherein the fixed body further comprises:

a plate; and a hollow cylinder extending from the plate along the longitudinal axis and defining a fixed body interior space, wherein the first contact surface is provided on a first side of the plate opposite the hollow cylinder, the second contact surface is on a second side of the plate opposite the first side and disposed within the fixed body interior space, and at least a portion of the second spring is provided within the fixed body interior space.

15. The electrical connector of claim 11, further comprising:

a hollow cylindrical spacer extending along the longitudinal axis and abutting the second contact surface, wherein at least a portion of the second spring is provided within an interior space of the hollow cylindrical spacer.

16. The electrical connector of claim 11, further comprising:

a retainer provided in the bore at the second end of the connector body, wherein the second electrical contact extends through the retainer.

17. The electrical connector of claim 11, further comprising:

a groove formed on an inner surface of the bore at a position along the longitudinal axis between the second contact surface and the second aperture;

a retainer ring provided within the groove;

a washer provided between the retainer ring and the conductive fixed body, the washer abutting the retainer ring; and a hollow cylindrical spacer positioned between the washer and the conductive fixed body, wherein the second electrical contact extends through the retainer ring and the washer, at least a portion of the second electrical contact is provided within an interior of the hollow cylindrical spacer, and the second spring is provided within the interior of the hollow cylindrical spacer.

18. The electrical connector of claim 17, wherein the hollow cylindrical spacer is monolithically formed with the conductive fixed body.

19. The electrical connector of claim 17, wherein the hollow cylindrical spacer is monolithically formed with the washer.

20. An electrical connector comprising:

a connector body extending along a longitudinal axis;

a first electrical contact provided at a first end of the connector body;

a first aperture provided in the first end of the connector body;

a bore provided in an interior of the connector body, the bore being connected to the first aperture;

a conductive fixed body provided within the bore, the conductive fixed body comprising a first contact surface on a first side of the conductive fixed body facing the first electrical contact along the longitudinal axis; and a first spring provided in the bore between the first contact surface and the first electrical contact, the first spring being in contact with the first contact surface and the first electrical contact, wherein the bore comprises:

a first bore portion having a first bore diameter;

a second bore portion axially adjacent to the first bore portion and having a second bore diameter larger than the first bore diameter;

the connector body further comprises an annular shoulder formed at a transition between the first bore portion and the second bore portion;

the first contact surface abuts the annular shoulder; and the first spring and at least a portion of the first electrical contact are disposed within the first bore portion.

* * * * *